US008226221B2

(12) United States Patent
Sugahara

(10) Patent No.: US 8,226,221 B2
(45) Date of Patent: Jul. 24, 2012

(54) INK CARTRIDGE AND INKJET RECORDING SYSTEM

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 605 days.

(21) Appl. No.: 12/400,781

(22) Filed: Mar. 9, 2009

(65) Prior Publication Data

US 2009/0160918 A1 Jun. 25, 2009

Related U.S. Application Data

(63) Continuation-in-part of application No. PCT/JP2007/069085, filed on Sep. 28, 2007.

(30) Foreign Application Priority Data

Sep. 29, 2006 (JP) ..... 2006-268986

(51) Int. Cl.
*B41J 2/175* (2006.01)

(52) U.S. Cl. ..... 347/86

(58) Field of Classification Search ..... 347/86
See application file for complete search history.

(56) References Cited

U.S. PATENT DOCUMENTS 4,371,881 A * 2/1983 Bork et al. ..... 347/29
5,572,245 A * 11/1996 Cowger ..... 347/44
5,682,186 A * 10/1997 Bohorquez et al. ..... 347/29
6,007,192 A * 12/1999 Ahn ..... 347/87
6,345,888 B1 2/2002 Matsumoto et al.
7,159,977 B1 * 1/2007 Putman et al. ..... 347/108
7,380,919 B1 * 6/2008 Anderson et al. ..... 347/84
2001/0012026 A1 * 8/2001 Kobayashi et al. ..... 347/19
2001/0048456 A1 12/2001 Higuma
2005/0117002 A1 6/2005 Tsukuda et al.

FOREIGN PATENT DOCUMENTS

JP H06-328713 A 11/1994
JP H07-241997 A 9/1995
JP H07-314721 A 12/1995
JP H11-005312 A 1/1999
JP H11-240172 A 9/1999
JP 2001-026115 A 1/2001

(Continued)

OTHER PUBLICATIONS

International Bureau; Notification of Transmittal of copies of Translation of the International Preliminary Report on Patentability in International Application No. PCT/JP2007/069085 (parent to the above-captioned U.S. patent application), mailed Apr. 30, 2009.
Japan Patent Office, Office Action for Japanese Patent Application No. 2006-268986 (counterpart to above-captioned patent application), mailed Feb. 14, 2012.

*Primary Examiner* — Charlie Peng
(74) *Attorney, Agent, or Firm* — Baker Botts L.L.P.

(57) ABSTRACT

An ink cartridge includes a cartridge main body and a pivoting member. The cartridge main body has an ink accommodating chamber accommodating ink therein and an ink outlet outputting ink in the ink accommodating chamber toward the inkjet recording device. The pivoting member is pivotably supported by the cartridge main body and that has a lid member configured of closing the ink outlet. The pivoting member pivots to move the lid member between a closing position and an opening position. The lid member closes the ink outlet at the closing position. The lid member opens the ink outlet at the opening position.

13 Claims, 16 Drawing Sheets

FOREIGN PATENT DOCUMENTS

| | | | |
|---|---|---|---|
| JP | 2001-347685 | A | 12/2001 |
| JP | 2002-001988 | A | 1/2002 |
| JP | 2002-337353 | A | 11/2002 |
| JP | 2005-178362 | A | 7/2005 |

* cited by examiner

INK CARTRIDGE AND INKJET RECORDING SYSTEM

CROSS REFERENCE TO RELATED APPLICATION

This application is a continuation-in-part of International Application No. PCT/JP2007/69085 filed on Sep. 28, 2007, by Hiroto SUGAHARA, which was not published in the English language and which claims the benefit of Japanese Patent Application No. 2006-268986, filed Sep. 29, 2006. The entire disclosures of the prior applications are hereby incorporated by reference herein in their entireties.

TECHNICAL FIELD

The invention relates to an ink cartridge for storing ink and an inkjet recording system provided with ink cartridge and an inkjet recording device.

BACKGROUND

An ink cartridge for storing ink is detachably mounted to an inkjet printer that ejects ink onto a recording medium such as a recording paper to record a desired image. Such an inkjet printer has a problem that ink leaks from the ink cartridge and contaminates the surrounding area when mounting or removing the ink cartridge.

An ink outlet port is for supplying ink. The ink outlet port opens, for example, when the ink cartridge is unsealed and mounted to the printer or when the empty ink cartridge is removed from the printer and is discarded. If vibration is applied to the ink cartridge, ink may leak from the ink outlet port to contaminate surrounding area.

Various ink cartridge have been proposed in order to prevent leakage of ink from the unsealed ink cartridge. For example, an ink cartridge disclosed in Japanese Patent Application Publication No. 06-328713 has a slide plate. The slide plate is attached to the side wall of the ink cartridge in a slidable manner so as to seal or open an ink outlet port (connection opening) formed in the side wall. The ink outlet port is closed by the slide plate when the ink cartridge is not mounted. At the time of use of the ink cartridge, the slide plate is slid to open the ink outlet port immediately before the ink cartridge is mounted to the printer.

SUMMARY

In the ink cartridge of Japanese Patent Application Publication No. 06-328713, the ink outlet port can be closed by the slide plate when the ink cartridge is not mounted in the printer. However, the ink outlet port needs to be opened for connecting to the printer before the ink cartridge is actually mounted in the printer. The ink cartridge is subject to vibration in the mounting operation of the ink cartridge, that is, in the operation connecting the ink outlet port to the printer. Thus, ink is likely to leak from the ink outlet port by the vibration and to contaminate inside of the printer (cartridge mounting portion) when mounting the ink cartridge.

An object of the invention is to provide an ink cartridge capable of preventing leakage of ink caused in a state where the ink cartridge is not mounted in the printer and preventing the leaked ink from adhering to surrounding area if ink leaks at the mounting or removing operation.

In order to attain the above and other objects, the invention provides an ink cartridge mountable on a cartridge mounting section of an inkjet recording device in a mounting direction.

The ink cartridge includes a cartridge main body and a pivoting member. The cartridge main body has an ink accommodating chamber accommodating ink therein and an ink outlet outputting ink in the ink accommodating chamber toward the inkjet recording device. The pivoting member is pivotably supported by the cartridge main body and that has a lid member configured of closing the ink outlet. The pivoting member pivots to move the lid member between a closing position and an opening position. The lid member closes the ink outlet at the closing position. The lid member opens the ink outlet at the opening position.

According to another aspects, the invention provides an ink cartridge. The ink cartridge includes a cartridge main body and a pivoting member. The cartridge main body has an ink accommodating chamber accommodating ink therein and an ink outlet outputting ink. The pivoting member is pivotably supported by the cartridge main body and that has a lid member configured of closing the ink outlet. The pivoting member pivots to move the lid member between a closing position and an opening position. The lid member closes the ink outlet at the closing position. The lid member opens the ink outlet at the opening position.

According to still another aspects, the invention provides an inkjet recording system. The inkjet recording system includes an inkjet recording device and an ink cartridge. The inkjet recording device has an inkjet head and a cartridge mounting section. The ink cartridge is mountable in the cartridge mounting section in a mounting direction. The ink cartridge includes a cartridge main body and a pivoting member. The cartridge main body has an ink accommodating chamber accommodating ink therein and an ink outlet outputting ink in the ink accommodating chamber toward the inkjet recording device. The pivoting member is pivotably supported by the cartridge main body and that has a lid member configured of closing the ink outlet. The pivoting member pivots to move the lid member between a closing position and an opening position. The lid member closes the ink outlet at the closing position. The lid member opens the ink outlet at the opening position.

BRIEF DESCRIPTION OF THE DRAWINGS

Embodiments in accordance with the invention will be described in detail with reference to the following figures wherein:

FIG. 2(*b*) is a right side view of the ink cartridge shown in FIG. 2(*a*);

FIG. 2(*c*) is a bottom view of the ink cartridge shown in FIG. 2(*a*);

FIG. 11(*b*) is a right side view of the ink cartridge shown in FIG. 11(*a*);

FIG. 11(*c*) is a bottom view of the ink cartridge shown in FIG. 11(*a*);

FIG. 16(*b*) is a right side view of the ink cartridge shown in FIG. 16(*a*);

FIG. 16(*c*) is a bottom view of the ink cartridge shown in FIG. 16(*a*);

DETAILED DESCRIPTION

An embodiment of the invention will be described below. First, an inkjet recording system including an ink cartridge and an inkjet printer that uses ink supplied from the ink cartridge to record desired characters or images onto a recording paper will briefly be described with reference to FIG. 1.

Figure 1:
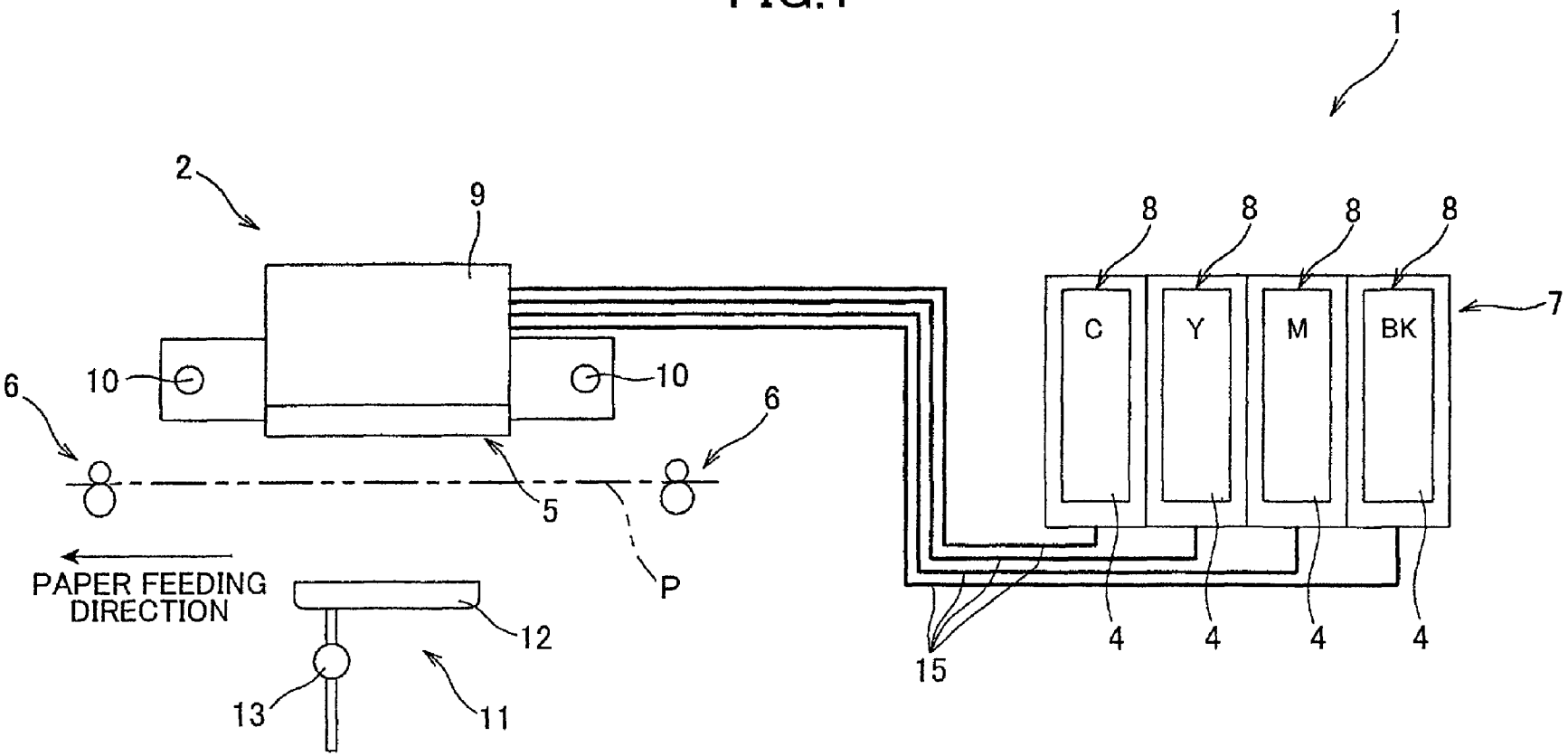
FIG. 1 is a configuration diagram conceptually showing an inkjet recording system according to an embodiment.

As shown in FIG. 1, an inkjet recording system 1 according to the embodiment of the invention includes an inkjet printer 2 (inkjet recording apparatus) that ejects ink onto a recording paper P to record a desired image, a control unit 3 (see FIG. 6) that controls the entire operation of the inkjet printer 2, and four ink cartridges 4 for storing inks of four colors (cyan (C), yellow (Y), magenta (M), and black (BK)) used in the inkjet printer 2.

The inkjet printer 2 includes an inkjet head 5 having a plurality of nozzles (not shown) that eject droplets of respective inks downward, a feeding mechanism 6 that feeds the recording paper P in the paper feeding direction (right-to-left direction in FIG. 1), and a holder 7 having four cartridge-mounting units 8 in which four ink cartridges 4 are mounted.

The inkjet head 5 is loaded on a carriage 9 that can move in a reciprocating manner along two guide shafts 10 extending in the perpendicular direction with respect to the paper surface of FIG. 1. The ink cartridges 4 are for storing inks of four colors. The ink cartridges 4 are detachably mounted respectively to the four cartridge-mounting units 8 in a predetermined mounting direction perpendicular to the paper surface of FIG. 1. The inkjet head 5 and four cartridge-mounting units 8 are connected to each other through four tubes 15. Thus, when the four ink cartridges 4 are mounted respectively to the four cartridge-mounting units 8, inks of four colors stored in the four ink cartridges 4 are supplied to the inkjet head 5 through the tubes 15.

The inkjet printer 2 ejects inks of four colors from the plurality of nozzles of the inkjet head 5 onto the recording paper P fed in the right-to-left direction of FIG. 1 by the feeding mechanism 6 while moving the inkjet head 5 integrally with the carriage 9 to record an image onto the recording paper P in the direction perpendicular to the paper surface of FIG. 1.

The inkjet printer 2 further includes a purge mechanism 1 for suctioning air entering in the ink flow path of the inkjet head 5 or ink that has become highly viscous. The purge mechanism 1 has a purge cap 12 and a suction pump 13. The inkjet head 5 has an ink ejecting surface (lower surface in FIG. 1) at which the plurality of nozzles open. The purge cap 12 can be mounted to the inkjet head 5 to cover the ink ejection surface and can move toward or away from the ink ejection surface. The suction pump 13 suctions ink from the nozzles. The purge mechanism 11 uses the suction pump 13 to perform suction operation when the purge cap 12 covers the ink ejection surface, thereby forcibly discharging air entering in the ink flow path or ink that has become highly viscous due to evaporation of water from the nozzles.

Next, the ink cartridge 4 will be described with reference to FIG. 2. The four ink cartridges 4 for storing inks of four colors have the same configuration, so that one of the four ink cartridges 4 will be described.

Figure 2A:
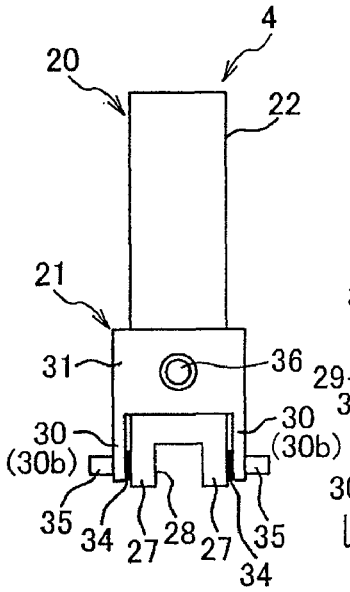
FIG. 2(*a*) is a front view of an ink cartridge according to the embodiment.
Figure 2B:
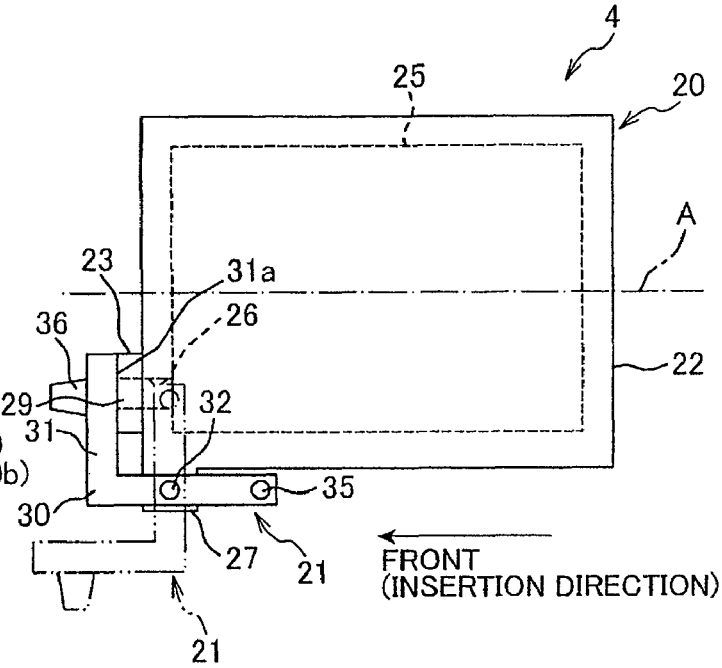
Figure 2C:
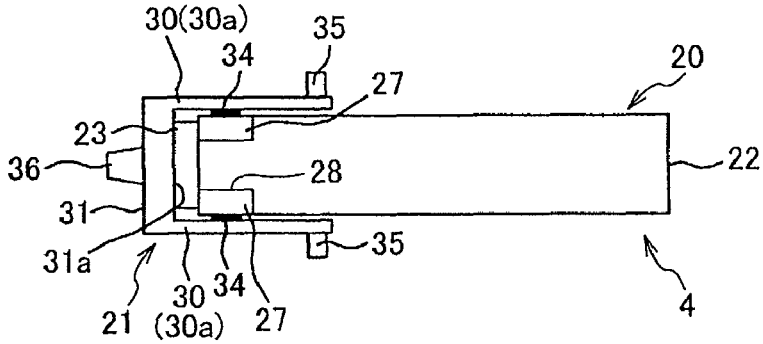

As shown in FIG. 2(*a*), the ink cartridge 4 includes a cartridge main body 20 and a pivoting member 21 pivotably supported by the cartridge main boy 20. The cartridge main body 20 has an ink chamber 25 for storing ink and an ink outlet port 29 for supplying ink outside from the ink chamber 25. The ink cartridge 4 is inserted into the cartridge-mounting unit 8 with the ink outlet port 29 facing the cartridge-mounting unit 8. Hereinafter, the insertion direction (the mounting direction) of the ink cartridge 4 into the cartridge-mounting unit 8 is defined as "front direction".

The cartridge main body 20 has an ink container 22 and a ring-shaped joint member 23 firmly fixed to the front end surface of the ink container 22. The ink container 22 has substantially a hexahedral (rectangular solid) shape and has two rectangular surfaces having the largest area opposing each other. The two rectangular surfaces are connected by remaining four surfaces. As shown in FIG. 2(*b*), the ink cartridge 4 is inserted (mounted) into the cartridge-mounting unit 8 along the longitudinal direction of the two rectangular surfaces in a posture (mounting posture) in which the two rectangular surfaces of the ink container 22 becomes side surfaces (see FIGS. 7 to 10).

The ink chamber 25 is provided in the ink container 22. An ink outlet path 26 is formed at the front end portion of the ink container 22. The ink outlet path 26 extends in the forward direction from the ink chamber 25. Two supporting parts 27 are formed at the front end portion of the ink container 22. The two supporting parts 27 are arranged in the width direction of the ink container 22. Each of the supporting parts 27 projects downward from the bottom surface of the ink container 22, thereby pivotably supporting the pivoting member 21 to be described later. Accordingly, a concave part 28 is formed between the two supporting parts 27. When mounting the ink cartridge 4, the concave part 28 is engaged with a guide portion 47 that is in a convex shape formed in the cartridge-mounting unit 8 (see FIGS. 7 to 10).

The joint member 23 is formed with the ink outlet port 29 that opens in the front direction and that fluidly communicates with the ink outlet path 26. That is, when the cartridge main body 20 is in the mounting posture, the joint member 23 (ink outlet port 29) is positioned on the front end side in the insertion direction of the ink cartridge 4. Further, in the mounting posture of the cartridge main body 20, the joint member 23 (ink outlet port 29) is positioned below a horizontal surface A passing through the center of gravity of the cartridge main body 20 (ink container 22). This configuration allows ink in the ink chamber 25 to be supplied through the ink outlet port 29 until no ink remains in the chamber 25. That is, ink in the ink chamber 25 is used up.

In a state where the ink cartridge 4 has been mounted to the cartridge-mounting unit 8, ink in the ink chamber 25 is supplied toward the cartridge-mounting unit 8 from the ink outlet port 29 through the ink outlet path 26 extending in the front direction. Here, the ink supply direction is parallel to the insertion direction of the ink cartridge 4 (front direction). The joint member 23 is preferably formed of a material having elasticity, such as rubber. In this case, when the ink cartridge is mounted in the cartridge-mounting unit 8, the joint member 23 can tightly be attached (see FIG. 10) to an attachment surface 49, thereby reliably preventing ink from leaking from the connection portion.

As shown in FIGS. 2(*a*) thorough 3, the pivoting member 21 has two arms 30 pivotably supported by the cartridge main body 20 and a lid portion 31 that is integrally connected to the two arms 30 and can close the ink outlet port 29 of the cartridge main body 20.

The arms 30 are each formed into an L-shape. The arms 30 each have two extending portions 30*a* and 30*b* extending in two directions perpendicular to each other and having different lengths from each other. That is, the extending portion 30*a* is longer than the extending portion 30*b* in the length direction. The two arms 30 are each arranged outside the two supporting parts 27 of the ink container 22 in the width direction. The two arms 30 are pivotably supported by the two supporting parts 27 through a pivoting axis 32 at the middle portion of the extending portion 30*a*. Thus, as shown in FIG. 2(*b*), the pivoting axis 32 (pivotably supported point) of the pivoting member 21 is positioned at a lower and rear side of the joint member 23 (ink outlet port 29). Further, torsion springs 34 are wound around the pivoting axis 32. Each of the arms 30 is urged in the clockwise direction in FIG. 2 (*b*) by the torsion springs 34.

The end portions of the shorter extending portions 30*b* of the two arms 30 are connected to the lid portion 31. The end portions of the longer extending portions 30 of the two arms 30*b* are substantially opposite to the lid portion 31 with respect to the pivoting axis 32 (pivotably supported point) of the arms 30. In other words, the pivoting axis 32 is positioned at substantially the center of the extending portions 30*a* in the longitudinal direction. Two horizontally projecting portions 35 horizontally extend outside with respect to the width direction and project from the end portions of the longer extending portions 30*a*. That is, the lid portion 31 is located substantially opposite to the two horizontally projecting portions 35 with respect to the pivoting axis 32. When mounting or removing the ink cartridge 4 in the cartridge-mounting unit 8, the two horizontally projecting portions 35 engage with two grooves 52 formed in the cartridge-mounting unit 8 and move in the insertion direction. According to these engagements, the arms 30 are pivoted by about 90 degrees (see FIGS. 9 to 10).

The lid portion 31 is formed into a rectangular flat plate in the same plane that includes the two extending portions 30*b*. The lid portion 31 is connected to the end portions of the two extending portions 30*b*. The two arms 30 pivots about the pivoting axis 32. According to this pivoting motions of the two arms 30, the lid portion 31 moves from a closing position at which the lid portion 31 closes the ink outlet port 29 to an opening position at which the lid portion 31 is away from the ink outlet port 29. Further, as described above, the pivoting member 21 is urged in the clockwise direction in FIG. 2(*b*) by the torsion springs 34 wound around the pivoting axis 32. That is, the lid portion 31 is urged toward the closing position by the biasing force of the torsion springs 34.

Figure 12:
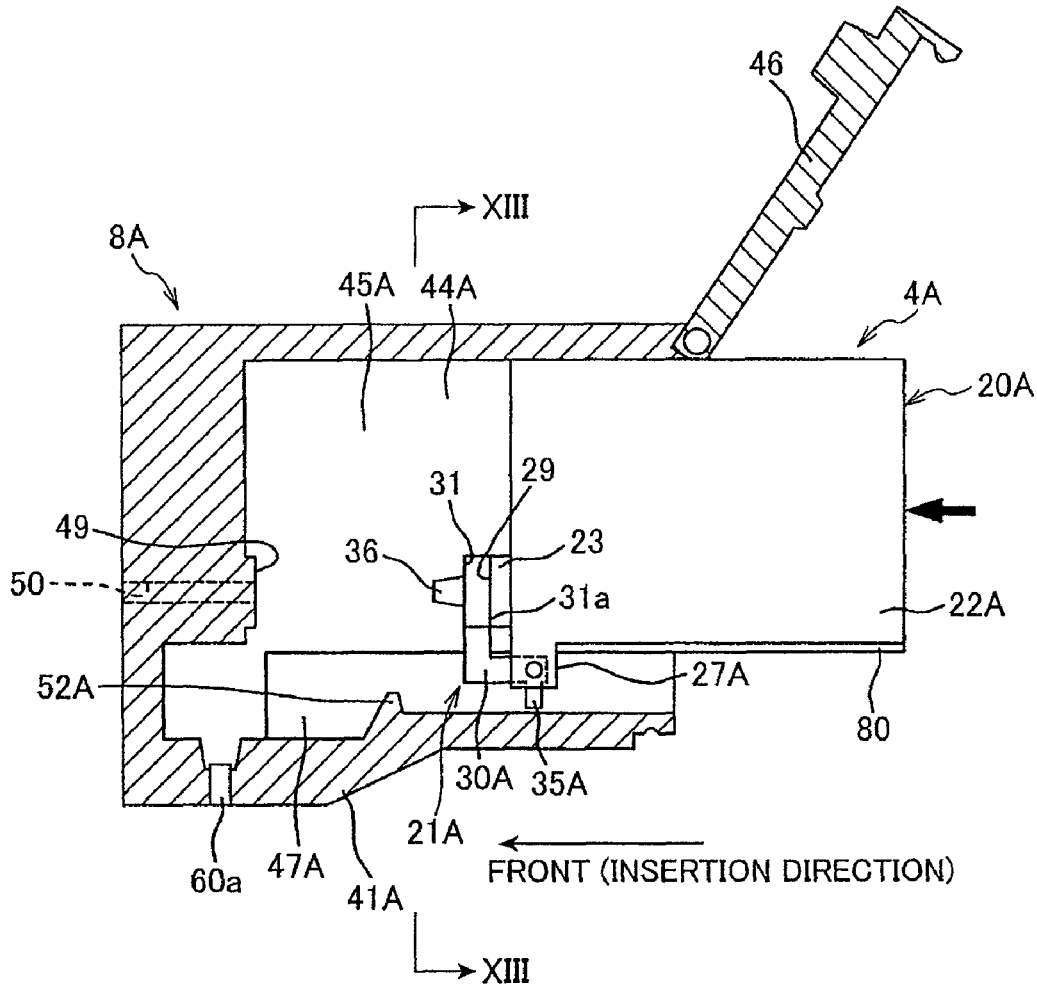
FIG. 12 is an illustrating diagram showing the ink cartridge and the cartridge-mounting unit before the pivoting member pivots.

When the cartridge main body 20 is in the mounting posture, as shown by a slid line in FIG. 2(*b*), the shorter extending portions 30*b* of the two arms 30 extend in the vertical direction (upward), that is, the shorter extending portions 30*b* are substantially parallel to the vertical direction. In this case, the lid portion 31 also extends in the vertical direction. The lid portion 31 is provided with a sealing surface 31*a*. The sealing surface 31*a* is a right side surface as shown in FIG. 12 and faces the ink outlet port 29 when the extending portions 30*b* extend in the vertical direction, that is, when the lid portion 31 is at the closing position. In this state (closing position), the sealing surface 31*a* is tightly attached to the front end surface of the joint member 23 to close the ink outlet port 29. Thus, when the lid portion 31 is positioned at the closing position, ink is prevented from leaking through the ink outlet port 29 by the lid portion 31.

On the other hand, when the extending portions 30*b* extend in the horizontal direction (front direction), that is, when the extending portions 30*b* are substantially parallel to the horizontal direction) as shown by a double-dot-and-dash line in FIG. 2 (*b*), the lid portion 31 also extends in the horizontal direction, and the sealing surface 31*a* of the lid portion 31 separates from the ink outlet port 29 formed in the front end surface of the joint member 23. Thus, when the lid portion 31 is positioned at the opening position, ink can be supplied in the front direction through the ink outlet port 29. Further, at the opening position, the lid portion 31 is away from the ink outlet port 29 and is positioned below the ink outlet port 29. Thus, if ink leaks through the ink outlet port 29 and drops downward, the ink is received by the sealing surface 31*a* of the lid portion 31 positioned below the ink outlet port 29.

Figure 3:
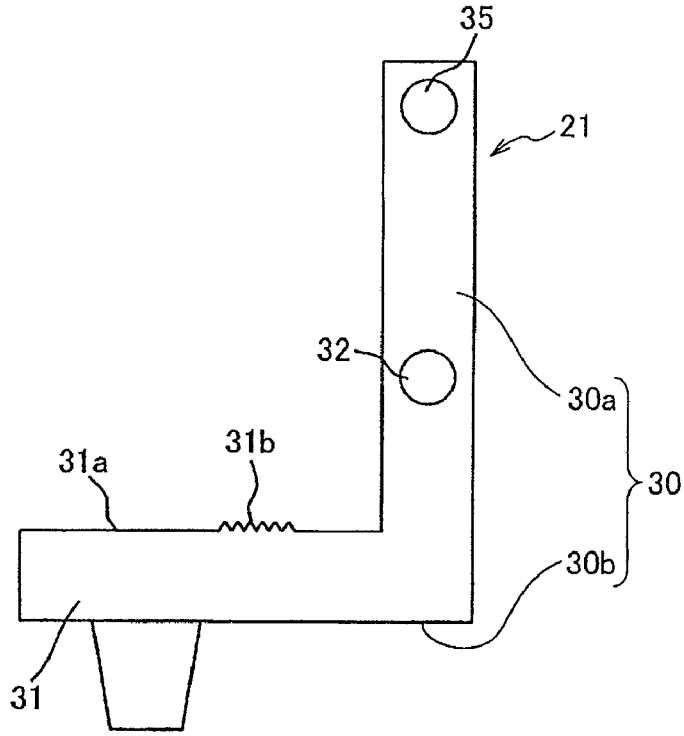
FIG. 3 is an enlarged view of a pivoting member when a lid member is at an opening position.

Further, as shown in FIG. 3, a zigzag portion 31*b* is formed on the sealing surface 31*a* having depressions and projections arranged alternatively. The zigzag portion 31*b* is positioned on the ink outlet port 29 side when the lid portion 31 is positioned at the closing position. Thus, when ink has dropped from the ink outlet port 29, the ink is received by the sealing surface 31*a* and then sucked by a capillary force into the concaves in the zigzag portion 31*b* to be captured. As a result, the ink is held by the sealing surface 31*a*, whereby the ink is prevented from dropping down from the lid portion 31. Further, as shown in FIG. 3, the zigzag portion 31*b* is formed at an area other than the end portion area continuing to the extending portions 30*b* on the sealing surface 31*a*, that is, the zigzag portion 31*b* is formed at an area other than the area that closes the ink outlet port 29 and that is brought into contact with the front end surface of the joint member 23. Thus, the zigzag portion 31*b* does not contact the ink outlet port 29 when the lid portion 31 is positioned at the closing position, so that high sealing performance can be maintained, whereby the ink outlet port 29 can reliably be closed.

Further, as shown in FIG. 2, a cone-like projecting portion 36 projects from the surface on the opposite side to the sealing surface 31*a* of the lid portion 31. When the ink cartridge 4 is mounted to the cartridge-mounting unit 8, the projecting portion 36 contacts a detection portion 60*a* (see FIG. 4) of a cartridge detection sensor 60 provided in the cartridge-mounting unit 8. The function of the projecting portion 36 will be described in detail later.

Figure 4:
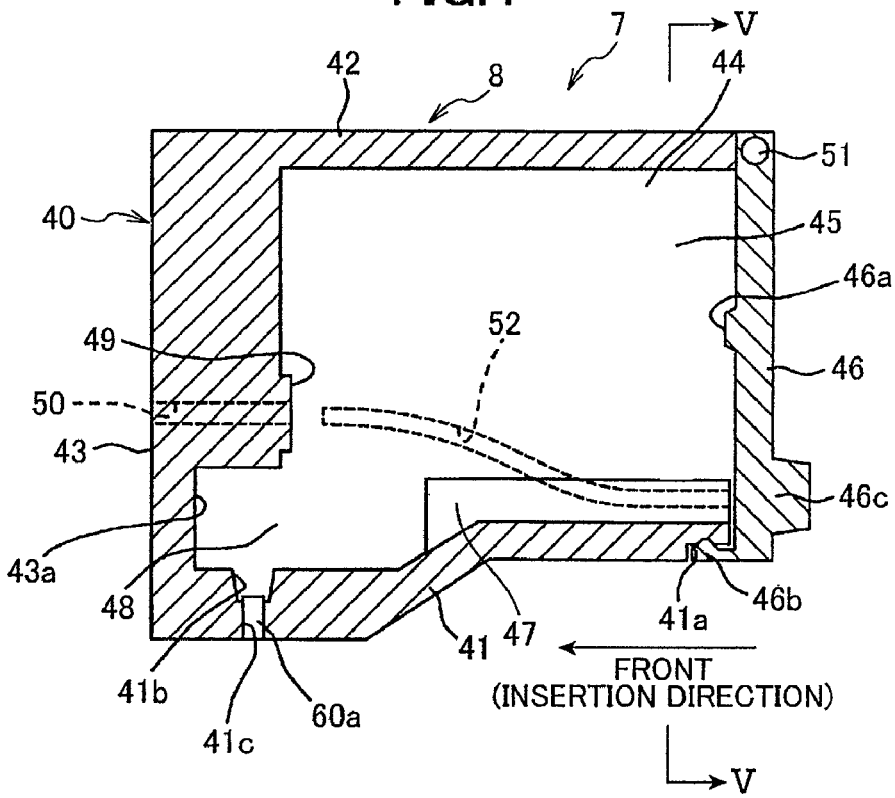
FIG. 4 is a cross section of a holder and a cartridge-mounting unit.

Next, the holder 7 provided in the inkjet printer 2 will be described. The abovementioned ink cartridge 4 is detachably mounted in the holder 7. FIG. 4 is a cross-section showing the holder 7 taken along a surface including the insertion direction, that is, taken along a direction perpendicular to the plane of the drawing in FIG. 1. As shown in FIG. 4, the holder 7 has a holder main body 40. The holder main body 40 is a substantially rectangular solid shape. In the holder main body 40, the four cartridge-mounting units 8 are arranged in the horizontal direction. The four ink cartridges 4 of four colors are respectively mounted in the four cartridge-mounting units 8. The four cartridge-mounting units 8 have the same configuration, so that one of the four cartridge-mounting units 8 will be described.

Figure 5:
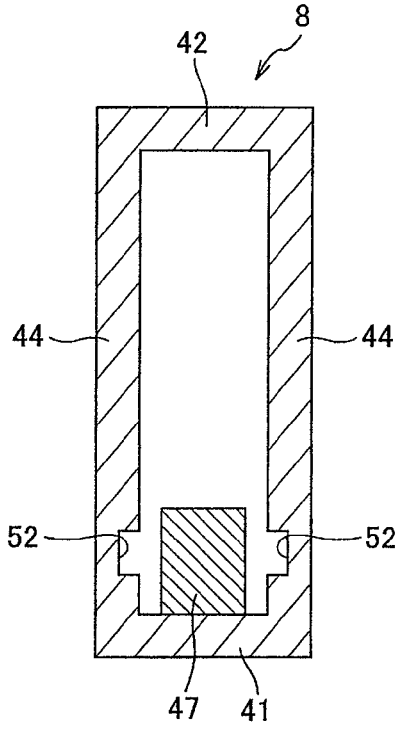
FIG. 5 is a cross section of the cartridge-mounting unit taken along a line X-X shown in FIG. 4.

The cartridge-mounting unit 8 has a bottom wall 41, a horizontal upper wall 42 facing the bottom wall 41, and a far end wall 43. The far end wall 43 extends in the vertical direction and connects the front end portions of the bottom wall 41 and the upper wall 42, that is, downstream side end portions of the bottom wall 41 and the upper wall 42 in the insertion direction. Further, as shown in FIG. 5, the cartridge-mounting unit 8 has side walls 44 arranged in a predetermined interval in the width direction (a direction perpendicular to the plane of the drawing in FIG. 4). Two adjacent cartridge-mounting units 8 are partitioned by these side walls 44. A cartridge-accommodating chamber 45 is formed inside the area surrounded by the bottom wall 41, upper wall 42, far end wall 43, and two side walls 44. The cartridge housing opens to upstream side in the insertion direction (rear side) and receives the ink cartridge 4 inserted from the upstream side. Further, a lid member 46 is pivotably connected to the upper wall 42. The lid member 46 closes and opens the cartridge-accommodating chamber 45.

The guide portion 47 is provided to the bottom wall 41. The guide portion 47 projects upward and extends in the insertion direction. The upper end surface of the guide portion 47 is horizontal. The guide portion 47 is configured to be engaged with the concave part 28 (see FIG. 2) between the two supporting parts 27 formed on the lower surface of the ink container 22. With this configuration, when mounting or removing ink cartridge 4, the guide portion 47 guides the ink container 22 in the insertion/removal direction while supporting the ink container 22 from below. Further, a concave portion 41*a* is formed in the end portion (rear end portion) of the bottom wall 41 on the upstream side in the insertion direction. The lid member 46 is engaged with the concave portion 41*a* when the lid member 46 closes the cartridge-accommodating chamber 45.

The front side (far end side) of the bottom wall 41 projects downward relative to the rear side of the bottom wall 41. A concave portion 43*a* is formed at the lower portion of the far end wall 43. The concave portion 43*a* is concaved toward the front side (far end side). Accordingly, a space 48 is formed around the corner portion of the cartridge-mounting unit 8 defined by the bottom wall 41 and far end wall 43. The space 48 expands downwardly toward the far end side from the cartridge-accommodating chamber 45.

Further, a concave 41*b* is formed in the far end upper surface (bottom surface of the cartridge-mounting unit 8) of the bottom wall 41, and a housing hole 41*c* is formed below the concave 41*b* and continues from the concave 41*b*. The detection portion 60*a* of the cartridge detection sensor 60 (see FIG. 6) is provided in the housing hole 41*c* and detects the mounting state of the ink cartridge 4. The detection portion 60*a* is vertically slidably provided in such a manner and slightly projects upward from the lower far end of the concave 41*b*. The cartridge detection sensor 60 detects presence or absence of the ink cartridge 4 based on whether or not the projecting portion 36 (see FIG. 2) contacts the detection portion 60*a*. The detection portion 60*a* is provided in the concave 41*b* as described above, so that the detection portion 60*a* is hardly brought into contact with an object other than the ink cartridge if the object other than the ink cartridge 4 is inserted into the cartridge-mounting unit 8. Therefore, the cartridge detection sensor 60 is prevented from erroneously detecting that the ink cartridge 4 is mounted in the cartridge-mounting unit 8.

Further, an attachment surface 49 and an ink flow path 50 are formed in the far end wall 43. When the ink cartridge 4 has been mounted to the cartridge-mounting unit 8, the front end surface of the joint member 23 is brought into contact with the attachment surface 49. The ink flow path 50 opens to the cartridge-accommodating chamber 45 at the attachment surface 49 and can fluidly communicate with the ink outlet port 29 of the ink cartridge 4. The ink flow path 50 is connected to the inkjet head 5 through the tube 15 (see FIG. 1).

The lid member 46 is connected to the end (rear end) of the upper wall 42 through a pivoting axis 51. The lid member 46 can pivot about the pivoting axis 51 from a closing position at which the lid member 46 closes the cartridge-accommodating chamber 45 to an opening position at which the lid member 46 is away from the cartridge-accommodating chamber 45.

A convex-shaped pressing portion 46*a* is formed on the inner surface of the lid member 46 at the middle portion of the lid member 46 in the longitudinal direction. That is, the convex-shaped pressing portion 46*a* faces the cartridge-accommodating chamber 45 when the lid member 46 is in the closing state (FIG. 4)). The pressing portion 46*a* is for pressing the ink cartridge 4 that has been inserted into the cartridge-accommodating chamber 45. Further, an engagement portion 46*b* is formed at the distal end of the lid member 46. The engagement portion 46*b* projects inward, that is, projects toward a longitudinal direction of the lid member 46. The engagement portion 46*b* is engaged with the concave portion 41*a* of the bottom wall 41, thereby disabling the lid member 46 positioned at the closing position from pivoting. Further, an operation portion 46*c* is formed on the outer surface of the lid member 46. A user pinches the operation portion 46*c* when the lid member 46 is opened or closed As shown in FIGS. 4 and 5, the grooves 52 are formed on the inner surface of the two side walls 44 (the inner surface of the cartridge-mounting unit 8) for defining the cartridge-accommodating chamber 45 in the width direction (a direction perpendicular to the plane of the drawing in FIG. 4). The grooves 52 extend from the upstream side (rear side) to the downstream side (front side) with respect to the insertion direction. At most upstream side in the insertion direction, the grooves 52 extend in parallel to the bottom wall 41 in the area near the bottom wall 41. At the center portion in the insertion direction, the grooves 52 extend inclined upward in the insertion direction from the area near the bottom wall 41. At the downstream side in the insertion direction, the grooves 52 extend upward in the insertion direction at a gentler slope than that at the center portion. The grooves 52 extend toward an area near the attachment surface 49 of the far end wall 43. When mounting or removing the ink cartridge 4, the horizontally projecting portions 35 (see FIG. 2) projecting from the pivoting member 21 engages with the grooves 52.

Figure 6:
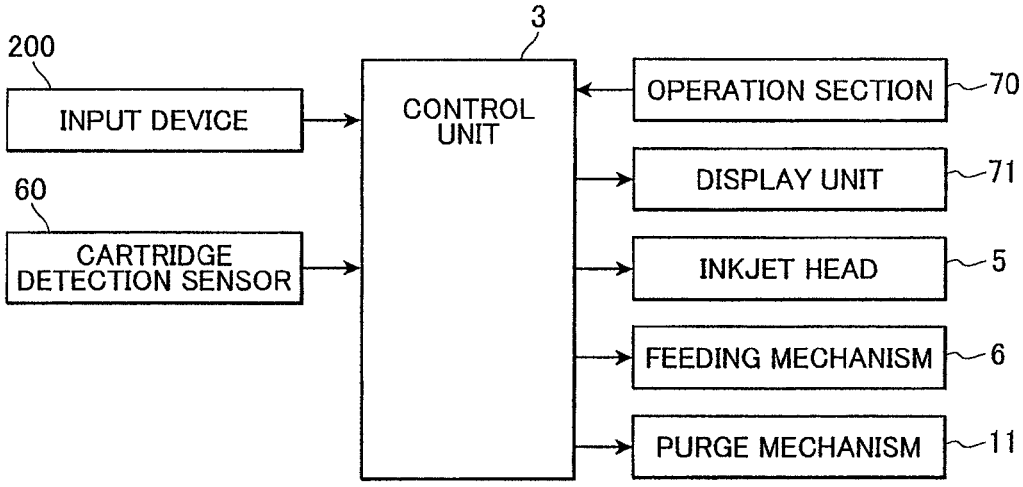
FIG. 6 is a block diagram conceptually illustrating a configuration controlling an inkjet printer.

Next, a control configuration (control unit 3) of the inkjet printer 2 will be described with reference to FIG. 6. The control unit 3 includes a CPU (Central Processing Unit), an ROM (Read Only Memory) storing various program and data for controlling the entire operation of the inkjet printer 2, an RAM (Random Access Memory) temporarily storing data to be processed by the CPU, and an I/O interface. The control unit 3 receives information, as an input, such as print data from an input device 200 such as a PC and receives various instructions, as an input, from an operation section 70 operated by a user. Further, the control unit 3 receives, as an input, a signal concerning presence/absence of the ink cartridge 4 from the cartridge detection sensor 60. Based on such input information, the control unit 3 controls operations of respective components in the inkjet printer 2, such as the inkjet head 5 and the feeding mechanism 6.

For example, when print data is inputted from the input device 200, the control unit 3 controls the feeding mechanism 6 to feed the recording paper P in the paper feeding direction, and controls the inkjet head 5 to move together with the carriage 9. Simultaneously, the control unit 3 controls the inkjet head 5 to eject ink droplets onto the recording paper P from the plurality of nozzles 5. Accordingly, characters or images corresponding to the print data are printed on the recording paper P. If there is something wrong with the recording operation onto the recording paper P, for example, if the ink cartridge 4 of a given color is not mounted to corresponding cartridge-mounting unit 8, the control unit 3 displays a message on a display unit 71 to notify a user of corresponding information. Further, when a purge command is input from a user through the operation section 70, or when it is needed to discharge, from the inkjet head 5, air or ink whose viscosity has been increased, the control unit 3 controls the purge mechanism 11 to purge the nozzles of the inkjet head 5.

Next, a series of operations of the ink cartridge 4 and the cartridge-mounting unit 8 when mounting or removing the ink cartridge 4 will be described with FIG. 4 and FIGS. 7 to 10.

At the beginning, as shown in FIG. 4, the lid member 46 closes the cartridge-accommodating chamber 45. In order to mount the ink cartridge 4 to the cartridge-mounting unit 8, the operation section 46*c* of the lid member 46 is operated to release an engagement between the engagement portion 46*b* and the concave portion 41*a*. Then, the lid member 46 pivots in the counterclockwise direction in FIG. 4 to allow the cartridge-accommodating chamber 45 to be in an open state.

Figure 7:
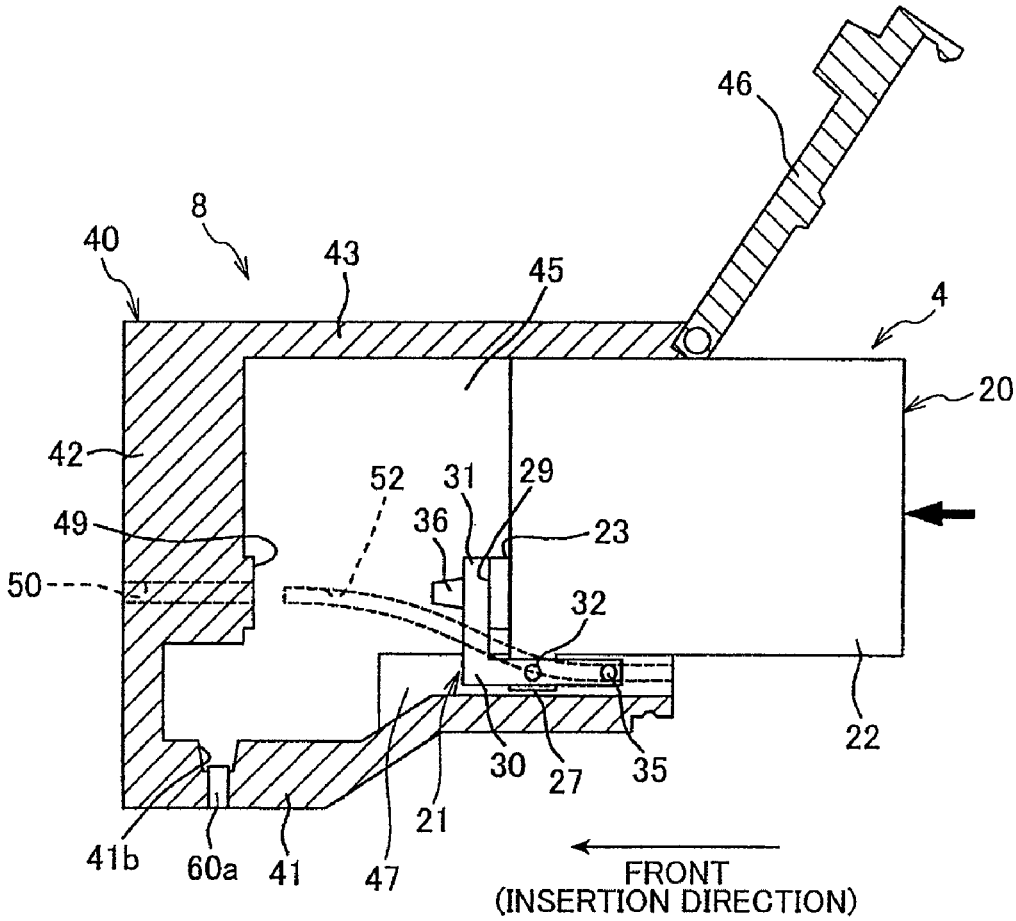
FIG. 7 is an illustrating diagram showing the ink cartridge and the cartridge-mounting unit before the pivoting member pivots.

Next, as shown in FIG. 7, the ink cartridge 4 is inserted into the cartridge-accommodating chamber 45. Here, before the ink cartridge 4 has completely been inserted into the cartridge-accommodating chamber 45, the lid portion 31 is urged toward the closing position by the biasing force of the torsion springs 34 and is tightly attached to the front end surface of the joint member 23, thereby closing the ink outlet port 29.

When the ink cartridge 4 is inserted, the guide portion 47 having a convex shape is engaged with the concave part 28 (see FIG. 2), and the lower surface of the ink container 22 is brought into contact with the upper surface of the guide portion 47. Further, two horizontally projecting portions 35 (see FIG. 2) are engaged respectively with the two grooves 52 formed in the two side walls 44. Then, the ink cartridge 4 moves in the front direction while the cartridge main body 20 and the horizontally projecting portions 35 are guided by the guide portion 47 and the grooves 52, respectively.

At the beginning of the insertion, as shown in FIG. 7, the horizontally projecting portions 35 engage with the portions of the grooves 52 that horizontally extend in parallel to the bottom wall 41 (upper surface of the guide portion 47). Thus, the pivoting member 21 moves in the front direction integrally with the cartridge main body 20 without pivoting.

Figure 8:
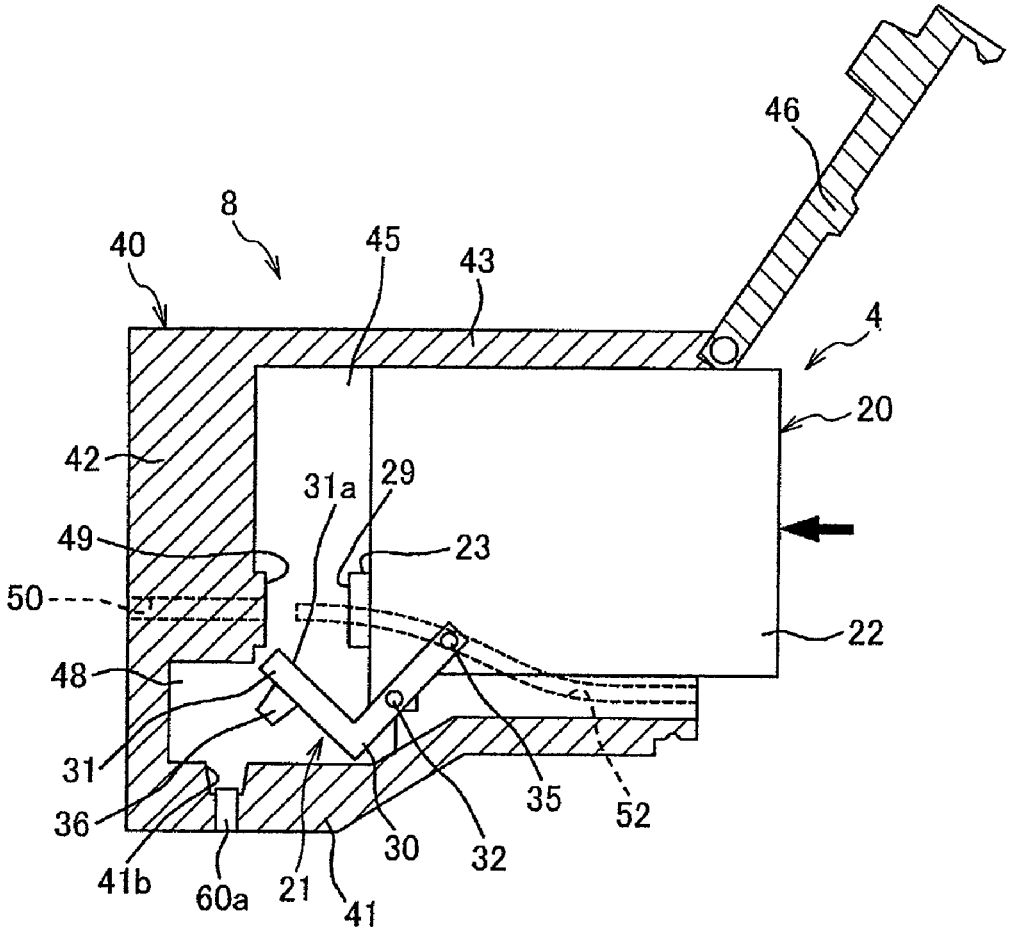
FIG. 8 is an illustrating diagram showing the ink cartridge and the cartridge-mounting unit when the pivoting member is pivoting.

As shown in FIG. 8, when the ink cartridge 4 is further inserted and the horizontally projecting portions 35 reach the portions of the grooves 52 that are inclined upward, the horizontally projecting portions 35 move upward along the inclination of the grooves 52. Then, by the upward movement of the horizontally projecting portions 35, the lid portion 31 pivots in the counterclockwise direction in the space 48 toward the opening position, against the urging force of the torsion springs 34. That is, the sealing surface 31*a* of the lid portion 31 moves downward and away from the front end surface of the joint member 23, whereby the ink outlet port 29 is opened.

Figure 9:
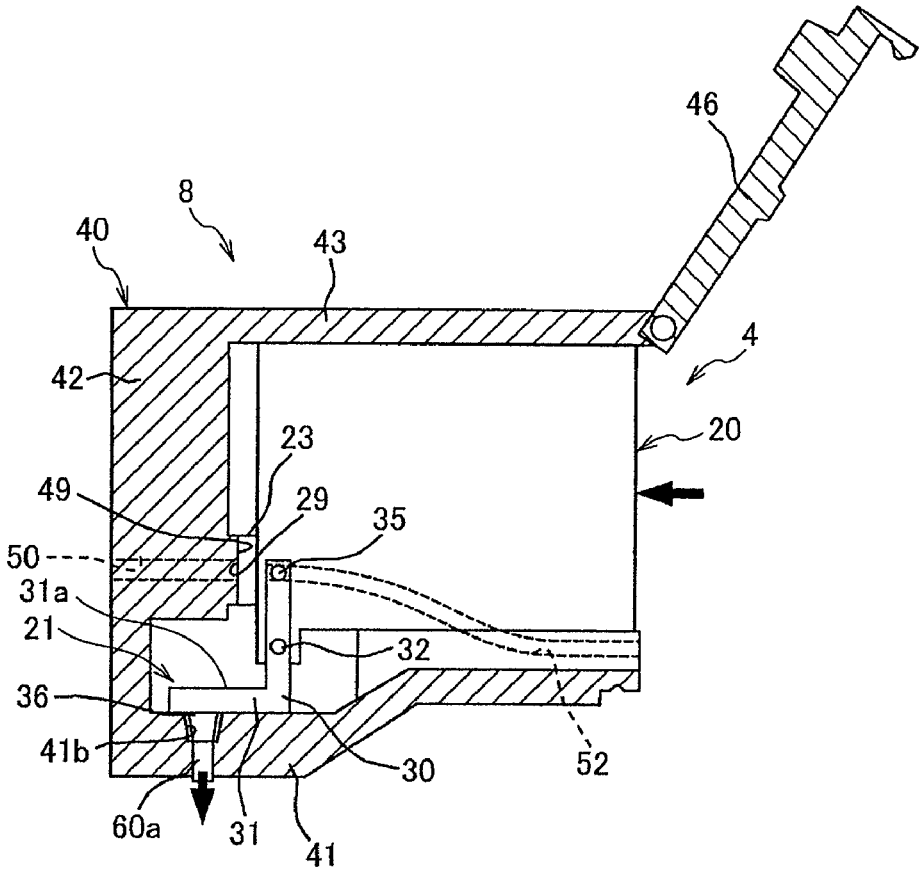
FIG. 9 is an illustrating diagram showing the ink cartridge and the cartridge-mounting unit after the pivoting member pivots.

Further, the horizontally projecting portions 35 reach the portions of the grooves 52 whose slope has become gentler, so that the lid portion 31 pivots the decreased pivoting speed relative to the pivoting speed in the state shown in FIG. 8. Subsequently, as shown in FIG. 9, the lid portion 31 reaches the opening position at which the lid portion 31 extends in the horizontal direction. That is, the lid portion 31 rotates by 90 degrees from the closing position at which the lid portion 31 extends in the vertical direction. At this time, the projecting portion 36 goes into the concave 41*b*, and the distal end of the projecting portion 36 is brought into contact with the detection portion 60*a* slightly projecting upward from the lower far end of the concave 41*b*, and presses the detection portion 60*a*. As a result, the cartridge detection sensor 60 detects that the ink cartridge 4 is mounted in the cartridge-mounting unit 8, and sends a detection signal to the control unit 3.

As shown in FIG. 9, when the ink cartridge 4 is still further inserted with the ink outlet port 29 being the open state, the front surface of the joint member 23 is brought into contact with the attachment surface 49 formed in the far end wall 43, and the ink outlet port 29 fluidly communicates with the ink flow path 50. As a result, ink stored in the ink chamber 25 can be supplied to the front direction, that is, toward the ink flow path 50 through the ink outlet port 29.

The pivotably supported point, i.e., the pivoting axis 32 is positioned below the ink outlet port 29. Thus, as compared to the conceivable case where the pivotably supported point is positioned above the ink outlet port, a force necessary to pivot the pivoting member 21 to move the lid portion 31 from the closing position to the opening position can be made smaller. Accordingly, the lid portion 31 smoothly pivots downward from the closing position, whereby the ink outlet port 29 is easily opened.

Further, the pivoting axis 32 (the pivotably supported point) is positioned on the rear side of the ink outlet port 29. With this configuration, the ink outlet port 29 and the lid portion 31 can be adjacent to each other in the insertion direction when the lid portion 31 is in the opening position. That is, the sealing surface 31*a* of the lid portion 31 can be positioned substantially just under the ink outlet port 29, whereby ink leaking through the ink outlet port 29 can reliably be received by the lid portion 31 from below.

Figure 10:
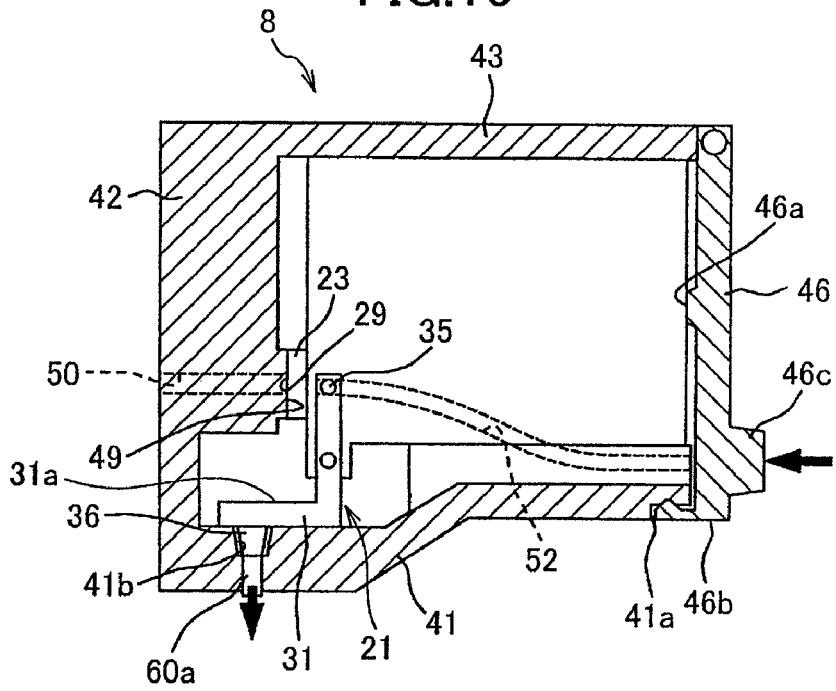
FIG. 10 is an illustrating diagram showing the ink cartridge and the cartridge-mounting unit after the ink cartridge is mounted in the cartridge-mounting unit.

Subsequently, as shown in FIG. 10, the lid member 46 positioned at the opening position pivots toward the closing position. Then, the pressing portion 46*a* of the lid member 46 is brought into contact with the rear end surface of the ink cartridge 4 to press the ink cartridge 4 toward the insertion direction. Accordingly, the joint member 23 is firmly attached to the attachment surface 49. Further, the engagement portion 46*b* engages with the concave portion 41*a*. Thus, the lid member 46 positioned at the closing position is disabled from pivotably moving. Accordingly, the tight attachment between the joint member 23 and the attachment surface 49 is maintained. After the lid member 46 is closed, the attachment of the ink cartridge 4 is completed. Ink is introduced through the ink outlet port 29 into the ink flow path 50 and then supplied to the inkjet head 5 through the tube 15 (see FIG. 1).

When the mounted ink cartridge 4 shown in FIG. 10 is removed from the cartridge-mounting unit 8, the operation section 46*c* is operated to release an engagement between the engagement portion 46*b* and the concave portion 41*a*, and the lid member 46 is pivoted from the closing position to the opening position. Accordingly, the cartridge container 45 becomes in an open state.

In this state, when the ink cartridge 4 in the cartridge-accommodating chamber 45 is pulled in the rear direction, the joint member 23 of the ink cartridge 4 is away from the attachment surface 49, and the horizontally projecting portions 35 moves to downward along the grooves 52, contrary to the mounting operation. Then, with the movement of the horizontally projecting portions 35, the pivoting member 21 pivots in the clockwise direction in FIG. 9. Then, the lid portion 31, which is positioned at the opening position away from the ink outlet port 29 and below the ink outlet port 29, moves to the closing position as shown in FIG. 7, thereby closing the ink outlet port 29. When the lid portion 31 starts to pivot from the opening position toward the closing position, the pressed state (contact state) of the detection portion 60*a* by the projecting portion 36 is released, so that the cartridge detection portion 60*a* detects that the ink cartridge 4 is not mounted to the cartridge-mounting unit 8, and send a detection signal to the control unit 3.

As described above, when mounting the ink cartridge 4, the pivoting member 21 pivots according to the movement of the ink cartridge. Then, the lid portion 31 moves from the closing position at which the lid portion 31 closes the ink outlet port 29 to the opening position that is away from the ink cartridge 29 and below the ink outlet port 29. On the other hand, when removing the ink cartridge 4, the pivoting member 21 pivots in the opposite direction to the direction when mounting. Then, the lid portion 31 moves to the closing position from the opening position that is away from the ink outlet port 29 and below the ink outlet port 29.

The ink outlet port 29 is opened only after the ink cartridge 4 is mounted in the cartridge-mounting unit 8. Thus, leakage of ink through the ink outlet port 29 and drying out of stored ink can be prevented when the ink cartridge 4 is not mounted to the cartridge-mounting unit 8. Further, the lid portion 31 is positioned below the ink outlet port 29 during mounting or removing the ink cartridge 4. Therefore, the ink is received by the lid portion 31 positioned below the ink outlet port 29 even if, in the mounting or removing process, ink leaks through the ink outlet port 29 and drops downward due to vibration during moving the ink cartridge 4 or during connecting or disconnecting the joint member 23 (ink outlet port 29) to the cartridge-mounting unit 8. Accordingly, the inside of the cartridge-mounting unit 8 is prevented from being contaminated due to adhesion of the ink.

Further, the lid portion 31 opens or closes the ink outlet port 29 in association with the mounting or removing operation of the ink cartridge 4, thereby eliminating the need for a user to operate the pivoting member 21 to open the ink outlet port 29 before mounting the ink cartridge 4, as well as, to operate the pivoting member 21 to close the ink outlet port 29 by the lid portion 31 after removing the ink cartridge 4.

Further, the lid portion 31 is not separate from but connected to the cartridge main body 20 after mounted. This configuration prevents the lid portion from being lost. The lid portion 31 can close once again the ink outlet port 29 after removing the ink cartridge 4. Therefore, ink is prevented from leaking from the ink cartridge 4 after removing the ink cartridge. Accordingly, the surrounding area of the ink cartridge 4 is prevented from being polluted.

Next, modifications obtained by adding various changes to the embodiment will be described. The same reference numerals are given to the same parts as those already described in the abovementioned embodiment, and duplicate description therefore is omitted.

(1) The configuration in which the lid portion opens and closes the ink outlet port in association with the mounting or removing operation of the ink cartridge is not limited to the above embodiment in which the lid portion 31 opens and closes the ink outlet port 29 by the engagement between the horizontally projecting portions 35 and the grooves 52 (see FIGS. 7 to 10), but other configurations may be employed. Hereinafter, two configurations that can be employed will be described (first and second modifications).

(First Modification)

Figure 11A:
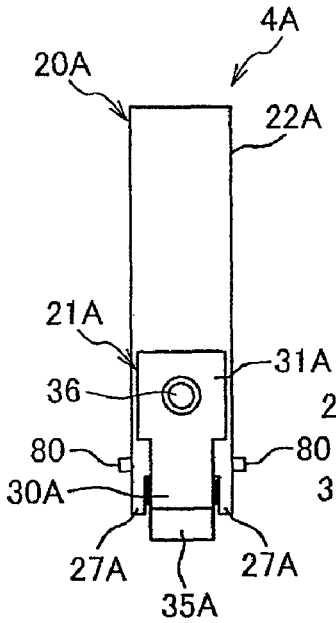
FIG. 11(*a*) is a front view of an ink cartridge according to a first modification.
Figure 11B:
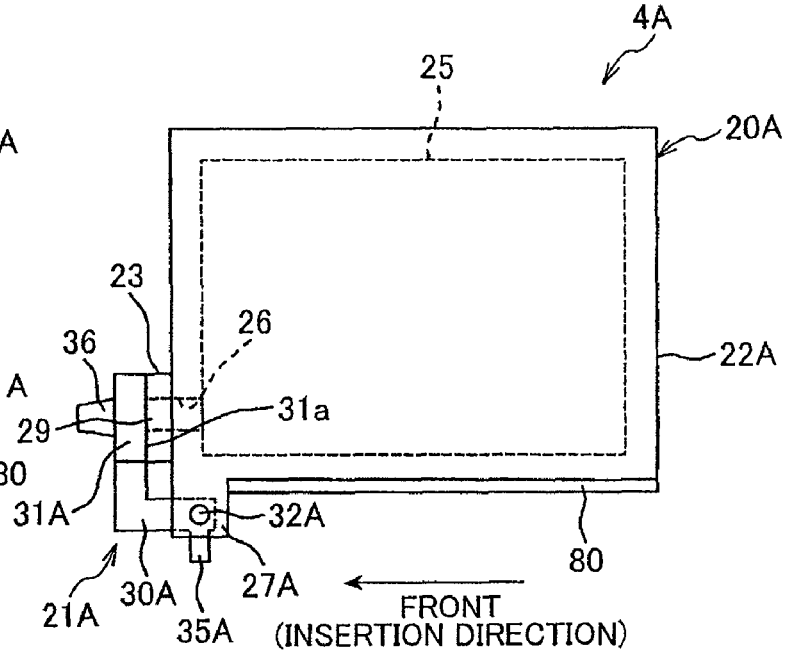
Figure 11C:
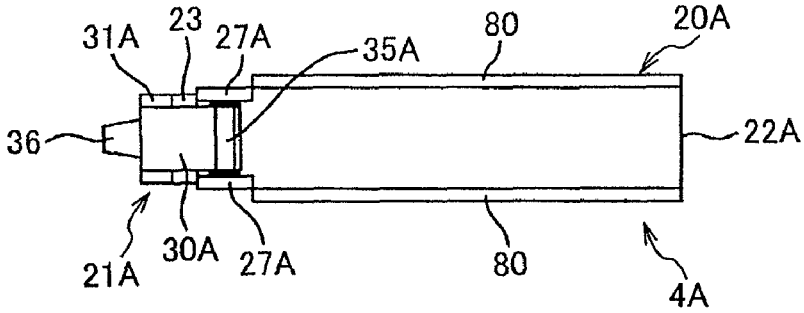

An ink cartridge 4A shown in FIG. 11 includes a cartridge main body 20A and a pivoting member 21A pivotably supported by the cartridge main boy 20A. The cartridge main body 20A has an ink container 22A provided with the ink chamber 25 and the joint member 23 firmly fixed to the front end surface of the ink container 22A. Two supporting parts 27A are formed at the front end portion of the ink container 22A. The two supporting parts 27 project downward from the lower surface of the ink container 22A along the side surface thereof. Further, two projecting guide portions 80 are formed at the lower end portion of the ink container 22A and project outside in the width direction along the lower surface of the ink container 22A and extend in the front-to-rear direction. The ink outlet port 29 formed in the joint member 23 fluidly communicates with the ink chamber 25 through the ink outlet path 26 formed at the front end portion of the ink container 22A.

The pivoting member 21A has an L-shaped arm 30A and a lid portion 31A. The L-shaped arm 30A is substantially L-shaped and pivotably supported by the two supporting parts 27A through a pivoting axis 32A. The lid portion 31A is connected to one end portion of the arm 30A. A projecting portion 35A are formed at the other end portion of the arm 30A which is positioned substantially opposite to the lid portion 31A with respect to the pivoting axis 32A (pivotably supported point). The projecting portion 35A projects in the direction (downward in the mounted state) parallel to the sealing surface 31*a* of the lid portion 30A. The projecting portion 35A is substantially opposite to the lid portion 31A with respect to the pivoting axis 32A. Further, the cone-like projecting portion 36 projects from the outer surface of the lid portion 31A (surface on the opposite side to the sealing surface 31*a*).

Figure 13:
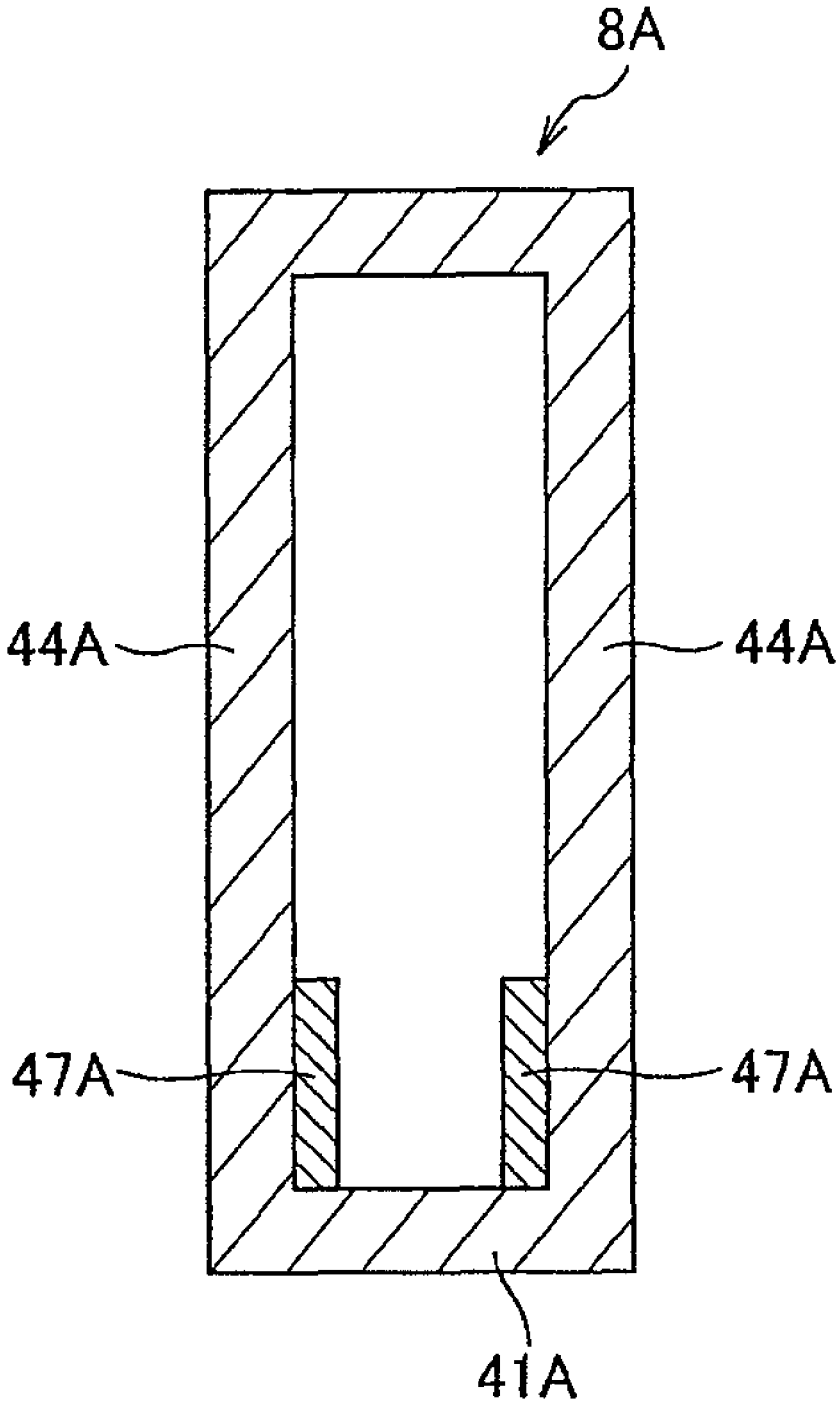
FIG. 13 is a cross section of the cartridge-mounting unit taken along a line XIII-XIII shown in FIG. 12 according to the first modification.

As shown in FIG. 12, a cartridge-mounting unit 8A is provided with a bottom wall portion 41A. A projecting portion 52A is formed at a center region of a bottom wall portion 41A in the front-to-rear direction. The projecting portion 52A projects upward. The both end sides of the projecting portion 52A with respect to an insertion direction are inclined. More specifically, the inclined surface located at downstream side (front side) in the insertion direction is longer (wider) than the inclined surface located at upstream side (rear side) in the insertion direction. As shown in FIG. 13, the cartridge-mounting unit 8A has two side walls 44A. Guide portions 47A projecting inward (toward inside of a cartridge-accommodating chamber 45) from the side walls 44A horizontally extend in the insertion direction.

Next, a series of operations of the ink cartridge 4A and cartridge-mounting unit 8A when mounting or removing the ink cartridge 4A will be described with FIGS. 12, 14, and 15.

As shown in FIG. 12, when the ink cartridge 4A is inserted into the cartridge-accommodating chamber 45A of the cartridge-mounting unit 8A for mounting the ink cartridge 4A, the bottom surface of the projecting guide portions 80 contact the upper surface of the guide portions 47A, and the bottom surface of the projecting guide portions 80 slide on the upper surface of the guide portions 47A. Accordingly, the ink cartridge 4A is guided in the front direction by the guide portions 47A.

When the projecting portion 35A is in a vertical posture, the projecting portion 35A extends in the vertical direction.

Figure 14:
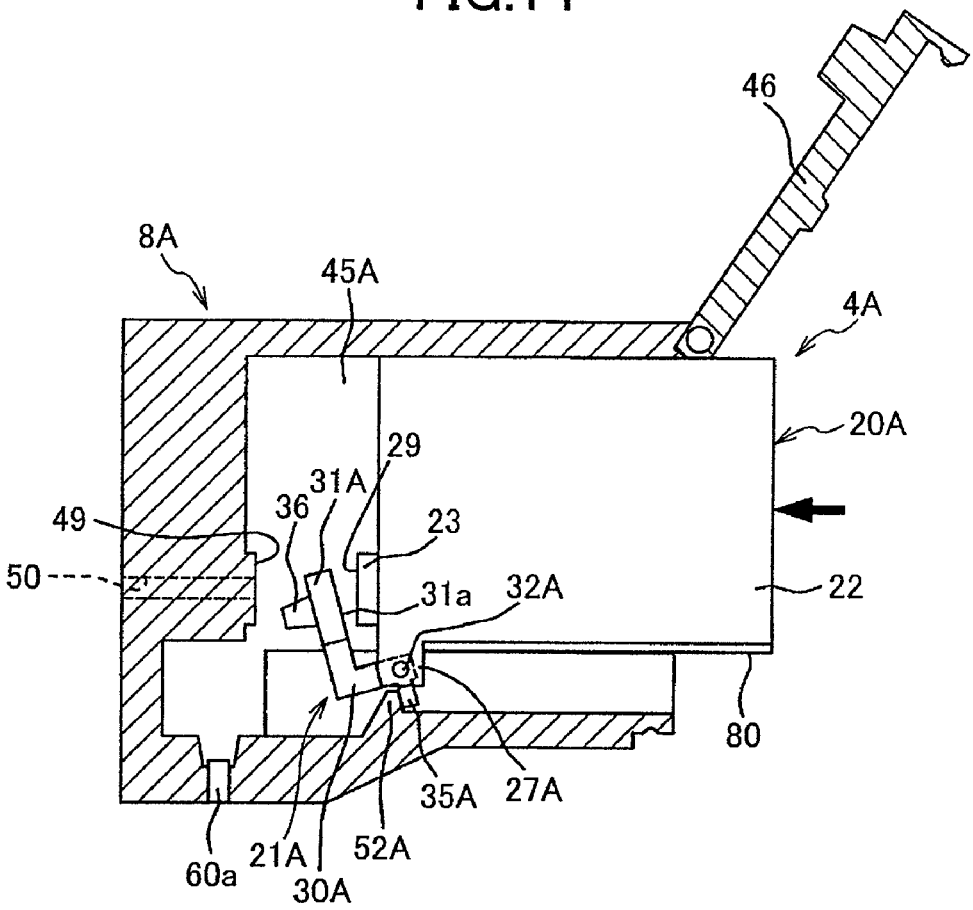
FIG. 14 is an illustrating diagram showing the ink cartridge and the cartridge-mounting unit when the pivoting member is pivoting according to the first modification.

As shown in FIG. 14, when the ink cartridge 4A is inserted more than half way into the cartridge-accommodating chamber 45A, the projecting portion 35A in a vertical posture is stopped by the rear side inclined surface of the projecting portion 52A and is prevented from proceeding in the far end direction (front direction). At this time, the supporting parts 27A are positioned above the projecting portion 52A and can move to the far end. Therefore, the cartridge main body 20A relatively moves in the forward direction relative to the projecting portion 35A that is stopped by the projecting portion 52A. As a result, the pivoting member 21A pivots in the counterclockwise direction in FIG. 14. Accordingly, the lid portion 31A is separated from the joint member 23 and starts moving downward.

When the ink cartridge 4A is further inserted, the lid portion 31A comes to a horizontal posture, in which the lid portion 31A extends in the horizontal direction, as the pivoting member 21A pivots and finally reaches the opening position. At the same time, the projecting portion 35A parallel to the lid portion 31A also comes to a horizontal posture in which the projecting portion 35A extends horizontally and, finally, an engagement between the projecting portion 35A and the projecting portion 52A of the bottom wall 41A is released. Then, as shown in FIG. 15, the front end surface of the joint member 23 is brought into contact with the attachment surface 49. Thus, the ink outlet port 29 fluidly communicates with the ink flow path 50. When the lid member 31A reaches the opening position, the projecting portion 36 on the outer surface of the lid portion 31A presses the detection portion 60*a*, and the cartridge detection sensor 60 detects that the ink cartridge 4A is mounted. Subsequently, the lid member 46 is closed, then, the mounting operation of the ink cartridge 4A is completed.

Figure 15:
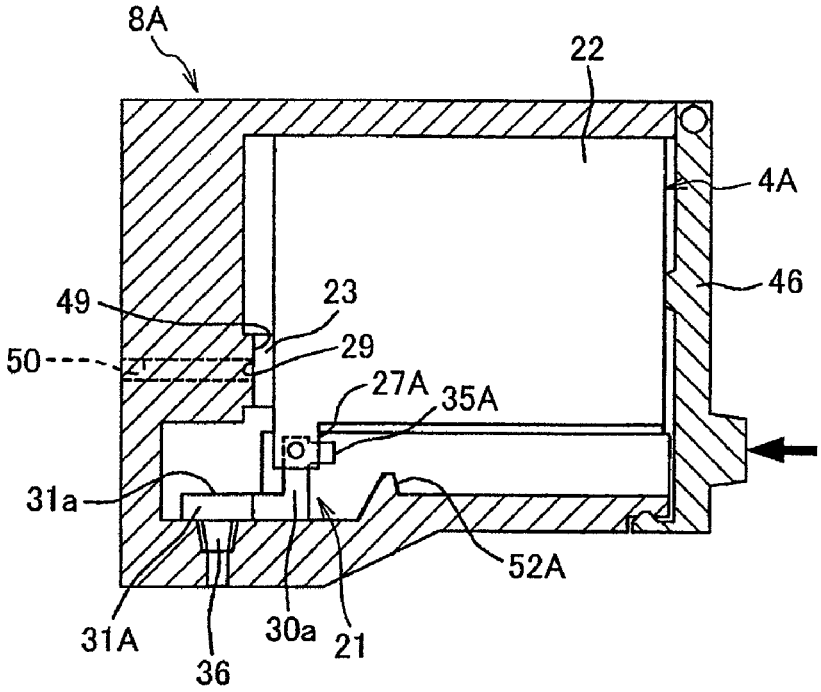
FIG. 15 is an illustrating diagram showing the ink cartridge and the cartridge-mounting unit after the pivoting member pivots according to the first modification.

In order to remove the mounted ink cartridge 4A shown in FIG. 15, the lid member 46 is pivoted to the opening position. Next, when the ink cartridge 4A is pulled, the arms 30A in a vertical posture (parallel to the vertical direction) are stopped by the front side inclined surface of the projecting portion 52A. Thus, as shown in FIG. 14, contrary to the mounting operation, the pivoting member 21A pivots in the clockwise direction. Accordingly, the lid portion 31A at the opening position starts to move upward. When the ink cartridge 4A is further pulled, as shown in FIG. 12, the lid portion 31A is brought into contact with the front surface of the joint member 23 to close the ink outlet port 29.

As described above, also in the configuration of the first modification, the lid portion 31A can open and close the ink outlet port 29 by pivoting the pivoting member 21A in association with the mounting or removing operation of the ink cartridge 4A.

(Second Modification)

Figure 16A:
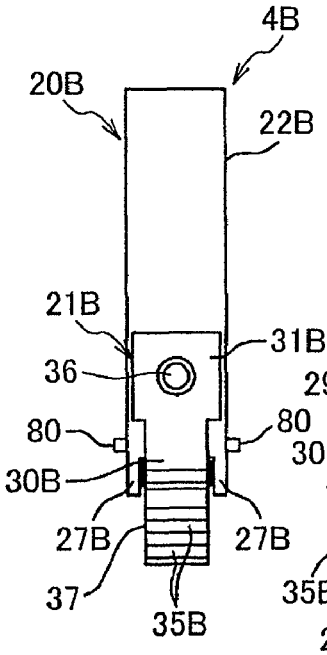
FIG. 16(*a*) is a front view of an ink cartridge according to a second modification.
Figure 16B:
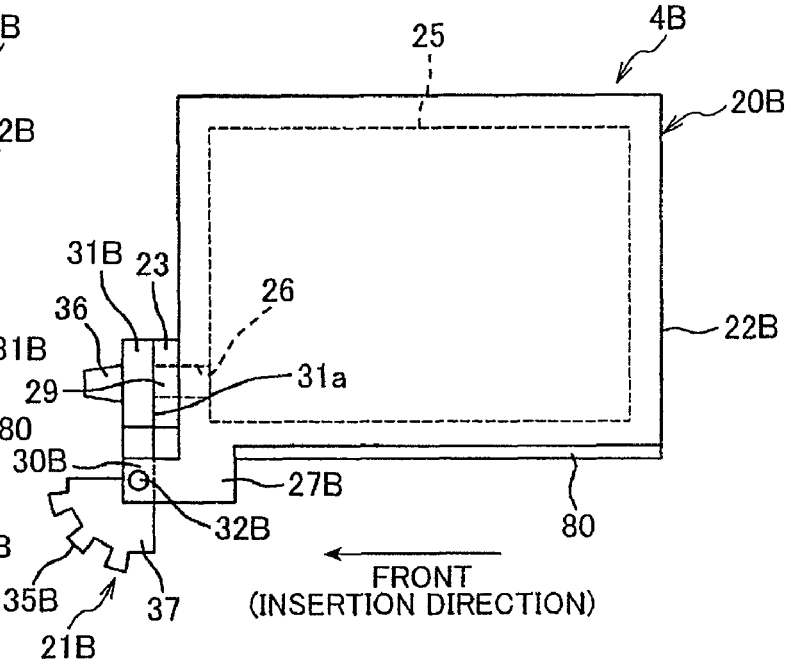
Figure 16C:
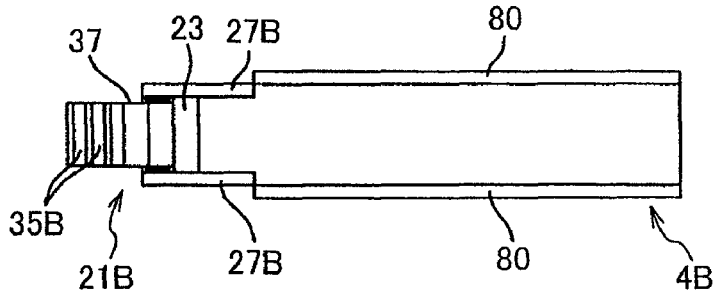

As shown in FIG. 16, an ink cartridge 4B includes a cartridge main body 20B and a pivoting member 21B pivotably supported by the cartridge main boy 20B. The cartridge main body 20B has an ink container 22B provided with the ink chamber 25 and the joint member 23 firmly fixed to the front end surface of the ink container 22B. Two supporting parts 27B are formed at the front end portion of the ink container 22B. The two supporting parts 27B are positioned below the joint member 23 and project further in the front direction than the joint member 23. As in the case of the first modification (see FIGS. 11 to 15), the two projecting guide portions 80 are formed at the lower end portion of the ink container 22B. The two projecting portions 80 project outside in the width direction outside along the lower surface of the ink container 22B and extend in the front-to-rear direction. The ink outlet port 29 formed in the joint member 23 fluidly communicates with the ink chamber 25 through the ink outlet path 26 formed at the front end portion of the ink container 22B.

The pivoting member 21B has an arm 30B and a pivoting axis 32B. The arm 30B is pivotably supported by the two supporting parts 27B through a pivoting axis 32B. The lid portion 31B is connected to one end portion of the arm 30B. As shown in FIG. 16 (*a*), the width of the arm 30B is slightly smaller than that of the lid portion 31B but is sufficiently large. A fan-shaped portion 37 and three teeth 35B are provided to the arm 30B. The fan-shaped portion 37 is provided at the other end portion of the arm 30B substantially opposite to the lid portion 31B with respect to the pivoting axis 32B (pivotably supported point). The fan-shaped portion 37 spreads in a fan-like form, from a pivotable portion that is pivotably supported by the pivoting axis 32B, with a central angle of substantially 90°. The three teeth 35B are arranged on the outer circumference of the fan-shaped portion 37 in the circumferential direction (i.e., pivoting direction of the pivoting member 21B) thereof. Further, the cone-like projecting portion 36 projects from the outer surface of the lid portion 31B (surface opposite to the sealing surface 31*a*). In the ink cartridge 4B of the second modification, the pivotably supported point (pivoting axis 32B) of the pivoting member 21B is supported by the two supporting parts 27B and is positioned on the front side (front direction side) of the ink outlet port 29. Further, when the lid portion 31B is at the closing position, the three teeth 35B are positioned on the front side (front direction side) of the lid portion 31B.

Figure 17:
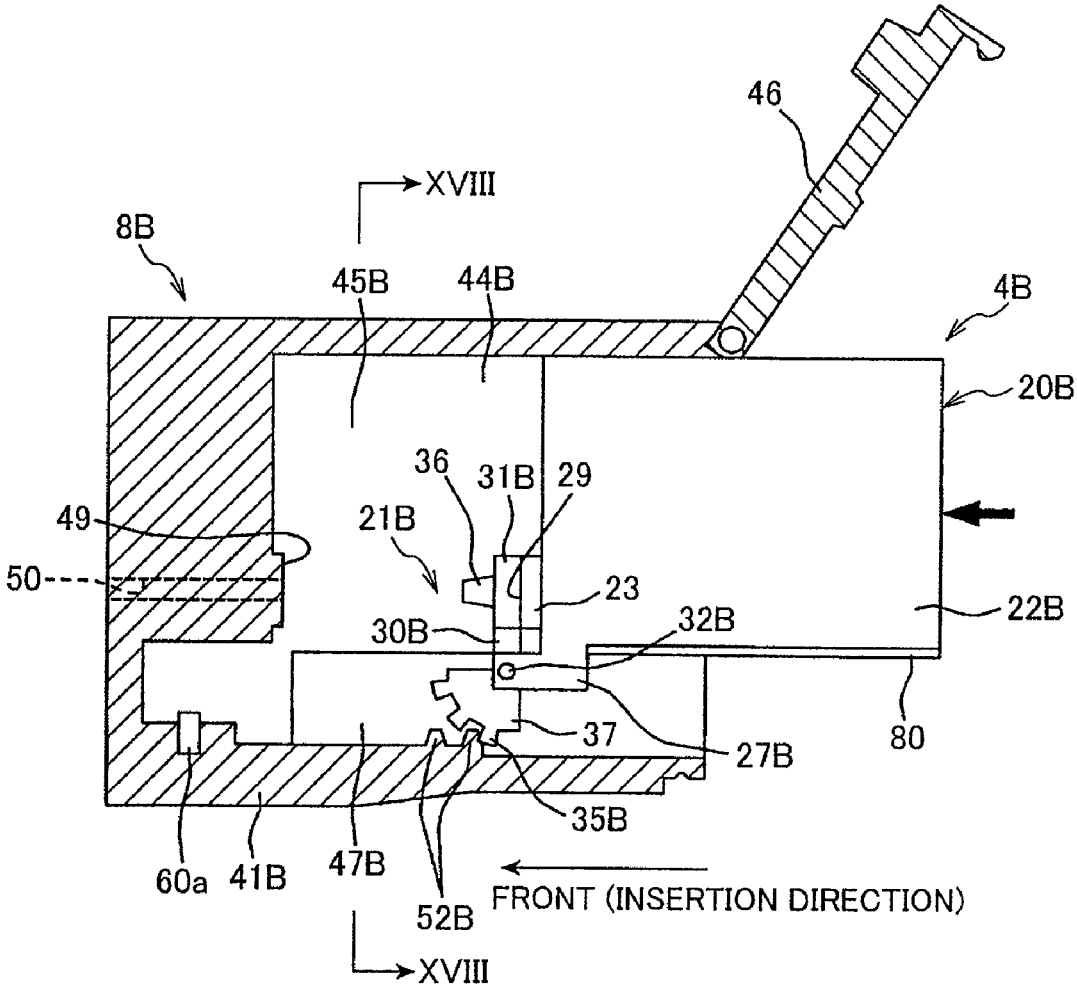
FIG. 17 is an illustrating diagram showing the ink cartridge and the cartridge-mounting unit before the pivoting member pivots.
Figure 18:
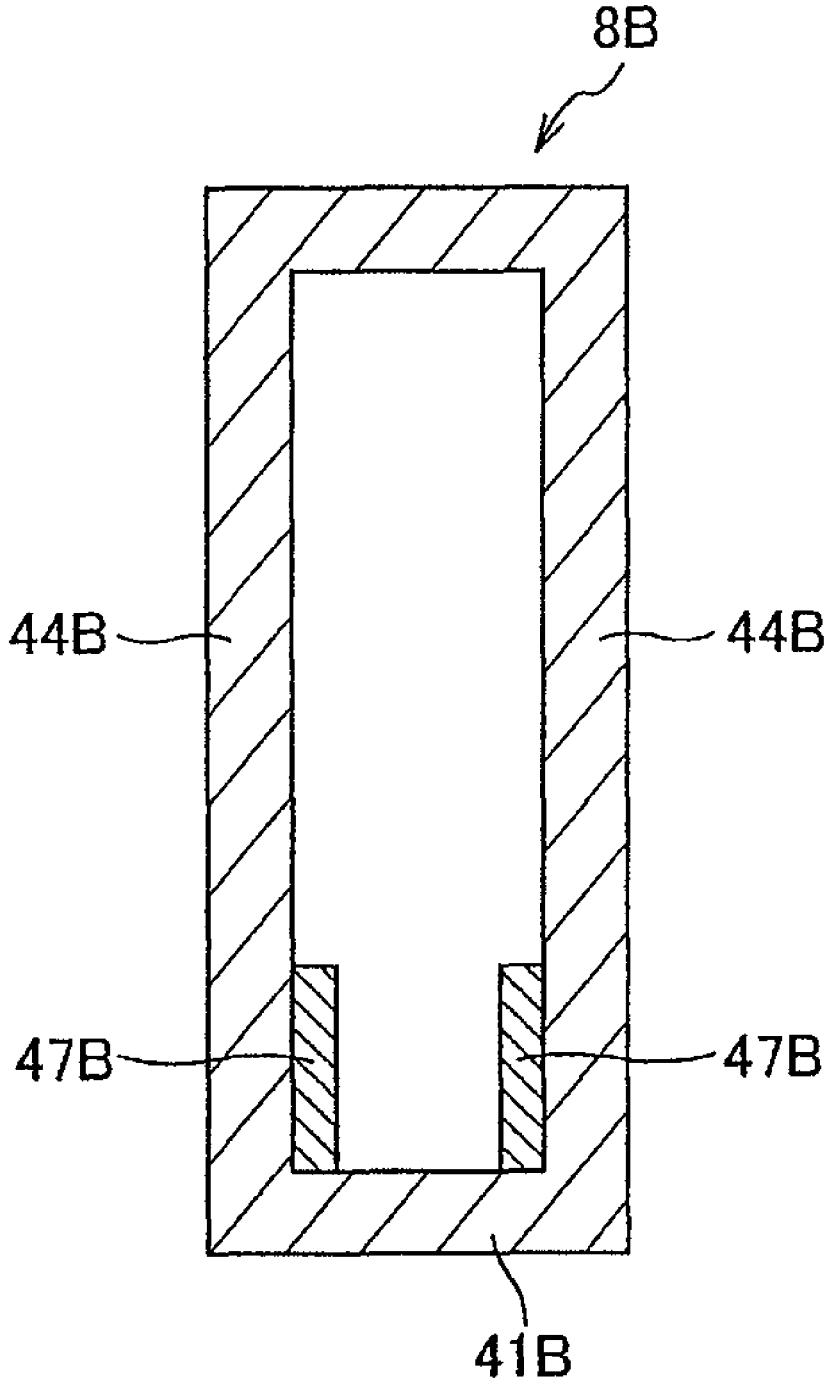
FIG. 18 is a cross section of the cartridge-mounting unit taken along a line XVIII-XVIII shown in FIG. 17 according to the second modification.

As shown in FIG. 17, a cartridge-mounting unit 8B is formed with a bottom wall 41B. The cartridge-mounting unit 8B is formed with two teeth 52B arranged in the front-to-rear direction at a center region of the bottom wall 41B thereof in the front-to-rear direction. Similarly to the first modification, as shown in FIG. 18, guide portions 47B horizontally extend in the insertion direction and project inward from the two side walls 44B of the cartridge-mounting unit 8B. Further, the detection portion 60*a* of the cartridge detection sensor 60 is fixedly provided in the far end of the bottom wall 41B of the cartridge-mounting unit 8B.

Next, a series of operations of the ink cartridge 4B and the cartridge-mounting unit 8B when mounting or removing the ink cartridge 4B will be described with FIGS. 17, 19, and 20.

As shown in FIG. 17, when the ink cartridge 4B is inserted into the cartridge-accommodating chamber 45B of the cartridge-mounting unit 8B for mounting the ink cartridge 4B, the bottom surface of the projecting guide portions 80 contact the upper surface of the guide portions 47B, and the bottom surface of the projecting guide portions 80 slide on the upper surface of the guide portions 47B. Accordingly, the ink cartridge 4B is guided in the front direction by the guide portions 47B.

Figure 19:
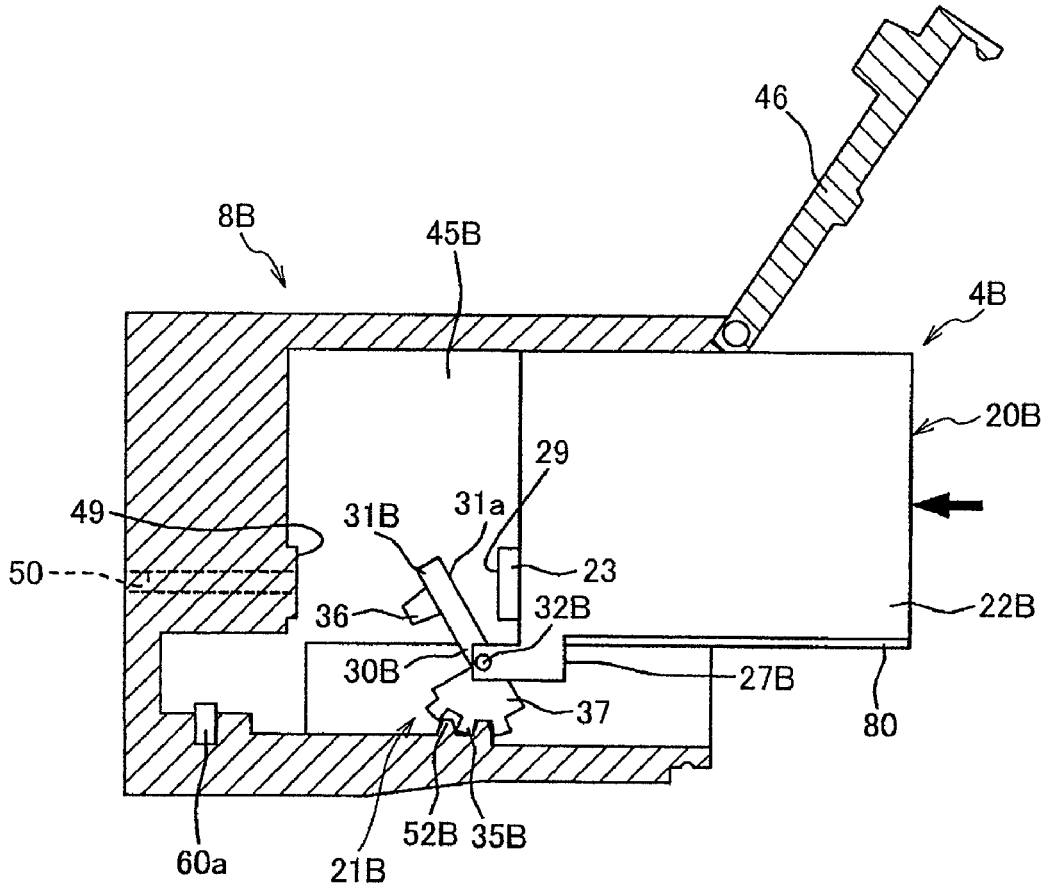
FIG. 19 is an illustrating diagram showing the ink cartridge and the cartridge-mounting unit when the pivoting member is pivoting.
Figure 20:
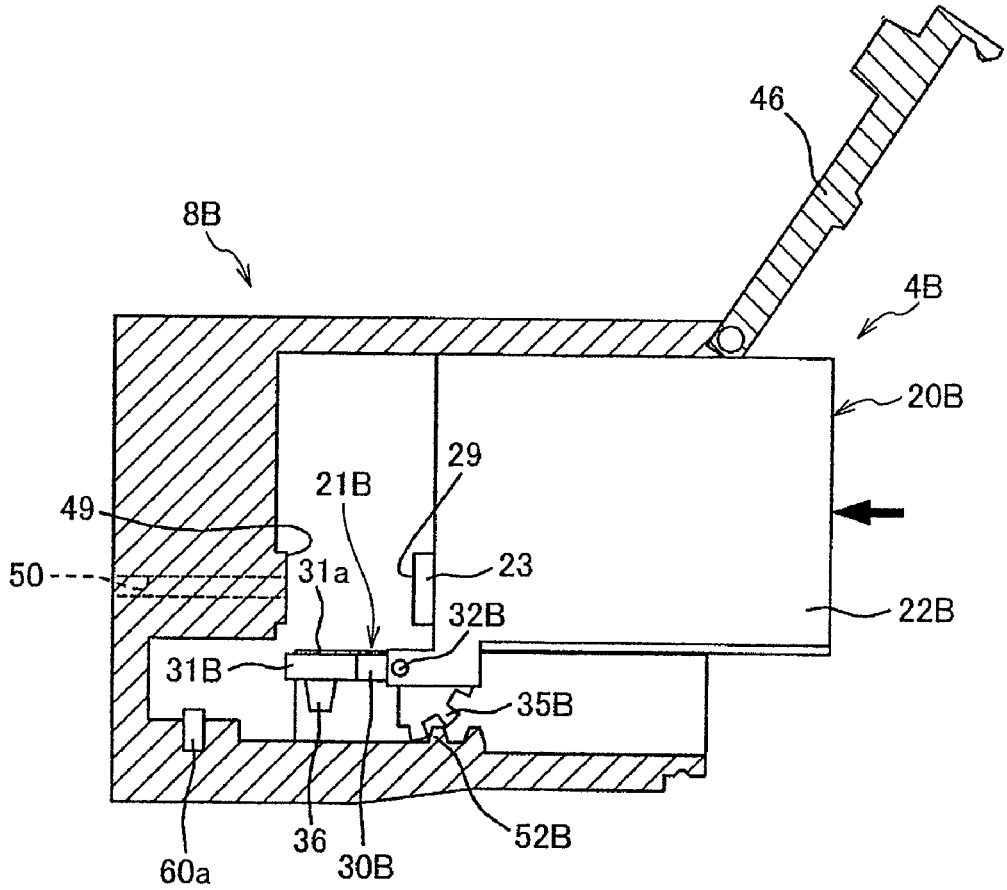
FIG. 20 is an illustrating diagram showing the ink cartridge and the cartridge-mounting unit after the pivoting member pivots.

As shown in FIG. 19, when the ink cartridge 4B is inserted nearly half way into the cartridge-accommodating chamber 45B, the three teeth 35B positioned on the front side (front direction side) of the lid portion 31B engages with the two teeth 52B. When the cartridge main body 20B is further inserted in this state, the arm 30B pivots in the counterclockwise direction. Accordingly, the lid portion 31B is separated from the joint member 23 and starts moving downward.

Figure 21:
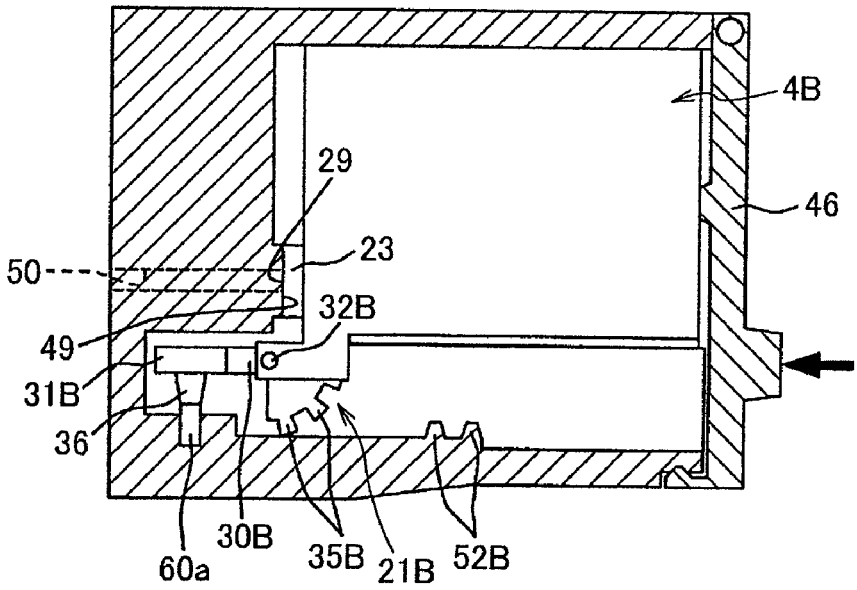
FIG. 21 is an illustrating diagram showing the ink cartridge and the cartridge-mounting unit after the ink cartridge is mounted in the cartridge-mounting unit.

When the ink cartridge 4B is further inserted, the pivoting member 21B pivots by 90 degrees. Accordingly, the lid portion 31B moves to the opening position at which the lid portion 31B is in a horizontal posture, that is, the lid portion 31B extends in the horizontal direction. At this time, an engagement between the three teeth 35B and two teeth 52B is released. Further, the pivoting member 21B moves in the far end direction integrally with the cartridge main body 20B in a state where the lid portion 31B is at the opening position. Then, as shown in FIG. 21, the front end surface of the joint member 23 is brought into contact with the attachment surface 49 and, thereby, the ink outlet port 29 fluidly communicates with the ink flow path 50. Further, the distal end of the projecting portion 36 moves to the far end and contacts the upper end of the detection portion 60*a* fixedly provided at the far end of the bottom wall 41B. Then, the cartridge detection sensor 60 detects that the ink cartridge 4B is mounted in the cartridge-mounting unit 8B. Subsequently, the lid portion 31B is closed, whereby the mounting operation of the ink cartridge 4B is completed.

In the second modification, the pivoting axis 32B is positioned on the front side (downstream side in the insertion direction) of the ink outlet port 29. As shown in FIG. 21, when the lid portion 31B is at the opening position, the sealing surface 31*a* is positioned lower than the ink outlet port 29 in the vertical direction, but is not positioned just under the ink outlet port 29, i.e., displaced in the front direction. However, the arm 30B continued from the lid portion 31B is positioned just under the ink outlet port 29. The width of the arm 30B is sufficiently large to receive the ink from the ink outlet port 29, though the width of the arm 30B is slightly smaller than that of the lid portion 31B. Therefore, if ink drops vertically downward from the ink outlet port 29, the ink is received by the arm portion 30B.

In order to remove the mounted ink cartridge 4B shown in FIG. 21, the lid member 46 is pivoted to the opening position. Next, when the ink cartridge 4B is pulled, the pivoting member 21B moves in the rear direction integrally with the cartridge main body 20B. Then, the three teeth 35B engages with the two teeth 52B. Then, contrary to the mounting operation, the pivoting member 21B pivots in the clockwise direction. Accordingly, the lid portion 31B at the opening position starts to move upward. As shown in FIG. 17, when the ink cartridge 4B is further pulled, the lid portion 31B is brought into contact with the front surface of the joint member 23 to close the ink outlet port 29.

As described above, in the configuration of the second modification, the lid portion 31B can open and close the ink outlet port 29 by pivoting the pivoting member 21B in association with the mounting or removing operation of the ink cartridge 4B.

(2) Configuration Pivoting a Pivoting Member in Association with a Mounting or Removing Operation of Ink Cartridge The grooves 52 and the horizontally projection portions 35 may not be included. That is, before the ink cartridge is inserted into the cartridge-mounting unit, the pivoting member may manually be operated by a user to move the lid portion to the opening position, and then the ink cartridge may be inserted. After removing the ink cartridge from the cartridge-mounting unit, the pivoting member may manually be operated by the user to close the ink outlet port by the lid portion. Here, in the case where the projecting portion 36 is formed on the outer surface of the lid portion 31 (surface on the opposite side to the sealing surface 31*a*) as shown in FIG. 2 of the above embodiment, the lid portion 31 can easily operated by pinching the projecting portion 36 in operations to open the ink outlet port immediately before mounting the ink cartridge or to close the ink outlet immediately after the ink cartridge is removed.

Further, the lid portion for opening and closing the ink outlet port is connected to the cartridge main body. Thus, if the lid portion is manually moved to the opening position before mounting the ink cartridge, the lid portion is not lost. Therefore, after removing the ink cartridge, the lid portion can be moved once again to the closing position to close the ink outlet port.

(3) The portion of the ink cartridge that contacts the detection portion 60*a* of the cartridge detection sensor 60 to detect the mounted state is not limited to the projecting portion 36 formed on the lid portion 31 in the embodiment. That is, the portion of the ink cartridge other than the projecting portion 36 may contact the detection portion 60*a* for detecting the mounted state of the ink cartridge. Further, the detection portion 60*a* of the cartridge detection sensor 60 need not be provided in the bottom surface of the cartridge-mounting unit, but the position of the detection portion 60*a* may be changed depending on the position of the contact portion of the ink cartridge. The detection portion 60*a* is preferably provided in the cartridge-mounting unit in order to prevent an object other than the ink cartridge from contacting the detection portion 60*a*. Further, in place of the contact-type detection portion 60*a*, a non-contact type detection portion, such as a transmission type optical sensor, may be provided in the cartridge-mounting unit.

What is claimed is:

1. An ink cartridge mountable on a cartridge mounting section of an inkjet recording device in a mounting direction, the ink cartridge comprising:

a cartridge main body that has an ink accommodating chamber accommodating ink therein and an ink outlet outputting ink in the ink accommodating chamber toward the inkjet recording device; and a pivoting member that is pivotably supported by the cartridge main body and that has a lid member configured of closing the ink outlet, the pivoting member pivoting to move the lid member between a closing position and an opening position, the lid member closing the ink outlet at the closing position, the lid member opening the ink outlet at the opening position, wherein the lid member at the opening position is positioned below the ink outlet in a vertical direction when the ink cartridge is in a mounting posture in which the ink cartridge is mounted on the cartridge mounting section, wherein the pivoting member pivots about a prescribed supporting portion of the cartridge main body that is positioned below the ink outlet when the ink cartridge is in the mounting posture in which the ink cartridge is mounted on the cartridge mounting section, and wherein the ink outlet is positioned at a downstream end of the ink cartridge with respect to the mounting direction.

2. The ink cartridge according to claim 1, wherein the lid member includes:

a first surface that faces the ink outlet when the lid member is at the closing position;

a second surface that is opposite to the first surface; and a projecting portion that projects from the second surface.

3. The ink cartridge according to claim 1, wherein the lid member includes a first surface that faces the ink outlet when the lid member is in the closing position, the first surface being formed with a zigzag part having depressions and projections arranged alternatively.

4. The ink cartridge according to claim 3, wherein the zigzag part is formed in a region of the first surface other than a region of the first surface that closes the ink outlet.

5. The ink cartridge according to claim 1, wherein the supporting portion is positioned at an upstream side of the ink outlet in the mounting direction.

6. The ink cartridge according to claim 1, wherein the ink outlet is disposed below a center of gravity of the cartridge main body when the ink cartridge is in the mounting posture in which the ink cartridge is mounted on the cartridge mounting section.

7. The ink cartridge according to claim 1, wherein the pivoting member includes an arm that pivots about a prescribed supporting portion of the cartridge main body and that has one end and another end opposite to the one end with respect to the supporting portion, the one end of the arm being connected to the lid member, the another end of the arm including an engaging portion, wherein the cartridge mounting section includes a mounting section engagement portion with which the engaging portion is engageable when the ink cartridge is mounted in the cartridge mounting section, wherein when the ink cartridge is mounted in the cartridge mounting section and the engaging portion engages with the mounting section engagement portion and moves in the mounting direction, the arm pivots to move the lid member from the closing position to the opening position.

8. The ink cartridge according to claim 7, wherein the mounting section engagement portion includes a groove with which the engaging portion is engageable, the groove being inclined upward in the mounting direction, wherein when the ink cartridge is mounted in the cartridge mounting section in the mounting direction and the engaging portion engages with the groove and moves upward along the groove, the lid member moves from the closing position to the opening position that is lower than the closing position in a vertical direction.

9. The ink cartridge according to claim 1, wherein the pivoting member includes an arm that pivots about a prescribed supporting portion of the cartridge main body and that has one end and another end opposite to the one end with respect to the supporting portion, the one end of the arm being connected to the lid member, the another end of the arm including a plurality of first teeth that is arranged in a pivoting direction of the pivoting member, wherein the cartridge mounting section includes a plurality of second teeth that is engageable with the first teeth when the ink cartridge is mounted in the cartridge mounting section in the mounting direction, wherein when the ink cartridge is mounted in the cartridge mounting section in the mounting direction and the plurality of the first teeth engage with the plurality of second teeth, the arm pivots to move the lid member from the closing position to the open position.

10. An inkjet recording system comprising:

an inkjet recording device that has an inkjet head and a cartridge mounting section;

an ink cartridge that is mountable in the cartridge mounting section in a mounting direction;

wherein the ink cartridge comprises:

a cartridge main body that has an ink accommodating chamber accommodating ink therein and an ink outlet outputting ink in the ink accommodating chamber toward the inkjet recording device; and a pivoting member that is pivotably supported by the cartridge main body and that has a lid member configured for closing the ink outlet, the pivoting member pivoting to move the lid member between a closing position and an opening position, the lid member closing the ink outlet at the closing position, the lid member opening the ink outlet at the opening position, wherein the lid member at the opening position is positioned below the ink outlet in a vertical direction when the ink cartridge is in a mounting posture in which the ink cartridge is mounted on the cartridge mounting section, wherein the pivoting member pivots about a prescribed supporting portion of the cartridge main body that is positioned below the ink outlet when the ink cartridge is in the mounting posture in which the ink cartridge is mounted on the cartridge mounting section, wherein the ink outlet is positioned at a downstream end of the ink cartridge with respect to the mounting direction.

11. The inkjet recording system according to claim 10, wherein the pivoting member includes an arm that pivots about a prescribed supporting portion of the cartridge main body and that has one end and another end opposite to the one end with respect to the supporting portion, the one end of the arm being connected to the lid member, the another end of the arm including an engaging portion, wherein the cartridge mounting section includes a mounting section engagement portion with which the engaging portion is engageable when the ink cartridge is mounted in the cartridge mounting section, wherein when the ink cartridge is mounted in the cartridge mounting section and the engaging portion engages with the mounting section engagement portion and moves in the mounting direction, the arm pivots to move from the closing position to the opening position.

12. The inkjet recording system according to claim 10, further comprising a detecting unit that detects whether the cartridge is mounted in the cartridge mounting section by contacting the ink cartridge.

13. The inkjet recording system according to claim 12, wherein the cartridge mounting section includes a bottom surface, wherein the lid member includes:

a first surface that faces the ink outlet when the lid member is at the closing position;

a second surface that is opposite to the first surface; and a projecting portion that projects from the second surface, wherein the projecting portion contacts the detecting unit when the ink cartridge is mounted and the lid member moves to the opening position.

* * * * *